US011795681B2

(12) United States Patent
Rutledge et al.

(10) Patent No.: US 11,795,681 B2
(45) **Date of Patent: *Oct. 24, 2023**

(54) STRUCTURAL FRAME FOR A BUILDING AND METHOD OF CONSTRUCTING THE SAME

(71) Applicant: Pace Building Technologies Inc., Whitby (CA)

(72) Inventors: Gerry Rutledge, Oshawa (CA); Nikola Muravljov, Belgrade (RS); Dejan Dikic, Toronto (CA)

(73) Assignee: Pace Building Technologies Inc., Whitby (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/845,082

(22) Filed: Jun. 21, 2022

(65) Prior Publication Data

US 2022/0325517 A1 Oct. 13, 2022

Related U.S. Application Data

(63) Continuation of application No. 17/122,002, filed on Dec. 15, 2020, now Pat. No. 11,377,839, which is a (Continued)

(51) Int. Cl.
*E04B 1/19* (2006.01)
*E04B 5/04* (2006.01)

(Continued)

(52) U.S. Cl.
CPC ..... *E04B 1/19* (2013.01); *E04B 1/04* (2013.01); *E04B 1/1903* (2013.01); *E04B 1/343* (2013.01);

(Continued)

(58) Field of Classification Search
CPC .. E04B 1/19; E04B 1/1903; E04B 2001/1996; E04B 2001/1948;

(Continued)

(56) References Cited

U.S. PATENT DOCUMENTS 938,458 A 11/1909 Brockhausen
2,741,908 A 4/1956 Swanson (Continued)

FOREIGN PATENT DOCUMENTS

CN 2752360 1/2006

OTHER PUBLICATIONS

Walsman Pe, Nathan, "Parking structure Options Precast vs. Cast-In-Place", Jul. 15, 2015 posted at https://schaefer-inc.com/parking-structure-options-pre-cast-vs-cast-in-place/.

(Continued)

*Primary Examiner* — Rodney Mintz
(74) *Attorney, Agent, or Firm* — Forsgren Fisher McCalmont DeMarea Tysver LLP; James M. Urzedowski; Daniel A. Tysver

(57) ABSTRACT

A structural frame for a building, comprising: adjacent first and second columns; at least one precast concrete floor slab having first and second corner indents located in two adjacent corners and a first elongated edge beam defined between the first and second corner indents, the first elongated edge beam being disposed between the first and second columns such that the first and second columns are received in the first and second corner indents and that the first elongated edge beam abuts the first and second columns; and a first tendon assembly extending between the first and second columns and adapted to be tensioned to compress the first elongated edge beam between the first and second columns, the first tendon assembly including at least one left cable and at least one right cable located symmetri- (Continued)

cally on either sides of a vertical center plane of the first and second columns.

32 Claims, 22 Drawing Sheets

Related U.S. Application Data continuation of application No. 15/857,955, filed on Dec. 29, 2017, now Pat. No. 10,895,071.

(51) Int. Cl.

| | |
|---|---|
| ***E04B 1/343*** | (2006.01) |
| ***E04B 5/02*** | (2006.01) |
| ***E04B 5/14*** | (2006.01) |
| ***E04B 5/29*** | (2006.01) |
| ***E04B 1/04*** | (2006.01) |
| ***E04B 5/28*** | (2006.01) |

(52) U.S. Cl.

CPC ..... *E04B 5/023* (2013.01); *E04B 5/04* (2013.01); *E04B 5/14* (2013.01); *E04B 5/28* (2013.01); *E04B 5/29* (2013.01); *E04B 2001/1948* (2013.01); *E04B 2001/1996* (2013.01); *E04B 2001/34389* (2013.01)

(58) Field of Classification Search

CPC .. E04B 2001/34389; E04B 5/023; E04B 5/04; E04B 5/14; E04B 5/28; E04B 5/29; E04B 1/20; E04B 1/21; E04B 1/22; E04B 2001/3583; E04B 1/41; E04B 1/4157; E04B 1/6112; E04B 5/17; E04B 1/04; E04B 1/343

USPC ..... 52/223.6, 223.7, 252, 253, 263, 414

See application file for complete search history.

(56) References Cited

U.S. PATENT DOCUMENTS

| | | | | |
|---|---|---|---|---|
| 2,871,544 | A | 2/1959 | Youtz | |
| 2,971,295 | A | 2/1961 | Reynolds | |
| 3,295,286 | A | 1/1967 | Schaich | |
| 3,378,971 | A | 4/1968 | Singer et al. | |
| 3,432,978 | A | 3/1969 | Erickson | |
| 3,613,325 | A | 10/1971 | Yee | |
| 3,903,667 | A | 9/1975 | Zetlin | |
| 3,962,088 | A | 6/1976 | Kuhlenschmidt | |
| 3,983,673 | A | 10/1976 | Camus | |
| 4,059,931 | A | 11/1977 | Mongan | |
| 4,065,897 | A | 1/1978 | Zezelj | |
| 4,324,037 | A | 4/1982 | Grady, II | |
| 4,409,764 | A | 10/1983 | Wilnau | |
| 4,428,174 | A | 1/1984 | Grady, II | |
| 4,919,122 | A | 4/1990 | Kohlenbrenner | |
| 5,367,854 | A | 11/1994 | Kim | |
| 5,507,124 | A | 4/1996 | Tadros | |
| 5,682,717 | A | 11/1997 | Carranza-aubry | |
| 6,128,878 | A | 10/2000 | Erickson | |
| 6,345,473 | B1 | 2/2002 | Fink | |
| 6,647,678 | B1 | 11/2003 | Zambelli | |
| 6,920,728 | B2 | 7/2005 | Powers | |
| 7,946,086 | B2 | 5/2011 | Hammer | |
| 8,919,058 | B2 | 12/2014 | Liberman | |
| 9,371,648 | B1 | 6/2016 | Tikhovskiy | |
| 9,765,521 | B1 | 9/2017 | Abbas | |
| 10,094,101 | B1 | 10/2018 | Jazzar | |
| 10,309,108 | B2 | 6/2019 | Sanabra Loewe | |
| 10,378,199 | B2 | 8/2019 | Calderon Uriszar-aldaca | |
| 10,865,557 | B2 | 12/2020 | Guo | |
| 10,895,071 | B2 | 1/2021 | Rutledge | |
| 11,339,562 | B2 * | 5/2022 | Heidenreich | E04B 1/32 |
| 11,377,839 | B2 * | 7/2022 | Rutledge | E04B 5/14 |
| 2001/0003234 | A1 | 6/2001 | Van Doren | |
| 2002/0092249 | A1 | 7/2002 | Yin | |
| 2004/0055246 | A1 * | 3/2004 | Powers | E04B 1/22 52/742.14 |
| 2005/0093190 | A1 | 5/2005 | Saddik | |
| 2011/0023397 | A1 | 2/2011 | Charvoz | |
| 2012/0110928 | A1 | 5/2012 | Liberman | |
| 2014/0041328 | A1 | 2/2014 | Stehle | |
| 2015/0068138 | A1 | 3/2015 | Rubel | |
| 2017/0159294 | A1 * | 6/2017 | Sanabra Loewe | E04C 5/125 |
| 2017/0175376 | A1 * | 6/2017 | Calderon Uriszar-Aldaca | E04B 1/215 |
| 2019/0203458 | A1 | 7/2019 | Rutledge | |
| 2020/0141110 | A1 | 5/2020 | Guo | |
| 2021/0140166 | A1 * | 5/2021 | Rutledge | E04B 5/14 |
| 2021/0293014 | A1 | 9/2021 | Heidenreich | |

OTHER PUBLICATIONS

Technical Brochure entitled "Precast Concrete Structures", undated, source www.paradigm.in.

Jun. 26, 2019 USPTO Office Action (U.S. Appl. No. 15/857,955)—Our Matter 5654.

Mar. 17, 2020 USPTO Office Action (U.S. Appl. No. 15/857,955)—Our Matter 5654.

Sep. 11, 2020 USPTO Office Action (U.S. Appl. No. 15/857,955)—Our Matter 5654.

Sep. 14, 2021 USPTO Office Action (U.S. Appl. No. 17/122,002)—Our Matter 6195.

Dec. 29, 2021 USPTO Office Action (U.S. Appl. No. 17/122,002)—Our Matter 6195.

* cited by examiner

STRUCTURAL FRAME FOR A BUILDING AND METHOD OF CONSTRUCTING THE SAME

TECHNICAL FIELD OF THE INVENTION

The invention relates to structural building systems, and more specifically to structural frames for buildings and to kits therefor.

BACKGROUND OF THE INVENTION

Structural frames form the backbone of most modern building structure. A structural frame, also known as a structural system, generally includes a plurality of structural members which are interconnected to resist and support loads.

Depending on the design, size and requirements of the building, different types of structural frames may be used.

Some structural frames include steel columns and steel horizontal support beams which are adapted to receive horizontal floor slabs made of concrete. This configuration is often used in the construction of high-rise buildings, for example. In this type of construction, a floor base made of metal or other material is placed on the horizontal beam and concrete is poured directly on the base to form the floor slabs. The steel columns may further be encased in concrete.

Unfortunately, this type of frame requires a relatively large quantity of fresh concrete to be transported from its manufacturing site to the construction site, usually in specialized vehicles, which increases the costs of construction.

Moreover, once the concrete has been poured, it must be cured for a certain period of time, which further increases the time required to construct the building. The exterior conditions on the construction site such as the temperature and humidity can also affect the cure time and the quality of the poured concrete. In some circumstances, these conditions could even make the structural frame unsafe.

To address some of the shortcomings of using this type of system, some structural systems include components which are prefabricated. For example, concrete slabs could be precast in manufacturing plants in controlled conditions to allow the quality of the concrete to be maximized. Unfortunately, when the slabs are provided at the construction site and placed next to each other, some amount of concrete may still need to be poured over the slabs to assemble them together.

Other systems include recessed bolts which connect together adjacent slabs at the interface between the slabs. Unfortunately, this type of connection may create local stress concentration near the edges of the slabs. Moreover, the slabs still need the horizontal support beams to prevent the slabs from failing in bending under vertical loads.

Chinese Patent No. CN2752360 discloses a system which includes a plurality of columns and precast slabs which are disposed horizontally next to each other and between the columns to define floors of a building structure. The precast slabs are generally held between adjacent columns, although rectangular insert pieces may be used instead of columns when vertical support is not required. Cable assemblies are run through the columns and tensioned to hold the slabs between the columns. Specifically, each cable assembly includes an upper cable and a lower cable disposed below the upper cable. Unfortunately, this configuration may not provide adequate rigidity to the assembled floors.

Furthermore, this system uses symmetrical slabs adapted to be positioned away from the perimeter of the building structure and asymmetrical slabs adapted to be positioned at the perimeter of the building structure. The asymmetrical slabs include internal perimeter channels which are adapted to be positioned along the perimeter of the building structure to house cables extending along the perimeter of the building structure and thereby prevent the cables from being exposed to the exterior of the building structure. Holes are also provided on the asymmetrical slabs to allow grout to be poured in the channels and on the cables once the cables are tensioned. The use of different types of slabs depending on their position in the building renders this system relatively complex and costly. Moreover, the grout may not be properly poured over the cables in the channels since the only access to the channel is provided through a relatively small hole.

It would therefore be desirable to provide a structural frame which tends to overcome at least one of the above-identified drawbacks.

BRIEF SUMMARY OF THE INVENTION

According to one aspect, there is provided a structural frame for a building, the structural frame comprising: a plurality of rectangular columns including a first column and a second column adjacent the first column, the first and second columns being spaced from each other by a first distance, the first column having a first vertical center plane and the second column having a second vertical center plane; at least one precast concrete floor slab having opposite first and second sides and opposite third and fourth sides defining four corners therebetween, the floor slab further having first and second corner indents located in two adjacent corners, each corner indent being sized and shaped to receive one of the first and second columns, the first and second corner indents extending inwardly from the first side towards the second side to define a first elongated edge beam therebetween, the first elongated edge beam having a length corresponding to the first distance between the first and second columns, the first elongated edge beam being disposed between the first and second columns such that the first and second columns are received in the first and second corner indents and that the first elongated edge beam abuts the first and second columns; and a first tendon assembly extending between the first and second columns, the first tendon assembly being adapted to be tensioned to thereby compress the first elongated edge beam between the first and second columns, the first tendon assembly including at least one left cable and at least one right cable located symmetrically on either sides of at least one of the first and second vertical center planes.

In one embodiment, the at least one precast concrete floor slab includes a first slab and a second slab adjacent the first slab and spaced from the first floor slab to define an elongated space therebetween, the first tendon assembly extending within the elongated space between the adjacent columns.

In one embodiment, the structural frame further includes grout received in the elongated space for encasing the first tendon assembly.

In one embodiment, the structural frame further includes a plurality of column reinforcement members, each column reinforcement member including a female connector extending through a corresponding one of the first and second adjacent columns and a rod portion engaging the female connector and extending into the elongated space to anchor the corresponding adjacent column to the grout in the elongated space.

In one embodiment, the first adjacent column includes a first perimeter column located on a perimeter of the building and the second adjacent column includes a central column located in the building away from the perimeter of the building.

In one embodiment, the plurality of columns includes a second perimeter column adjacent the central column, the second perimeter column being located opposite the first perimeter column and in alignment with the first perimeter column and the central column, the first tendon assembly being secured to the first and second perimeter columns and extending between the first and second perimeter columns through the central column.

In one embodiment, the at least one precast concrete floor slab further includes a third corner indent adjacent the second corner indent, the second and third corner indent extending inwardly from the third side towards the fourth side to define a second elongated edge beam therebetween, the second elongated edge beam having a length corresponding to the first distance between the first and second columns.

In one embodiment, the plurality of columns further includes a third column adjacent the second column, the first and second columns being aligned along a first axis and the second and third columns being aligned along a second axis perpendicular to the first axis, the second and third column being spaced apart by the first distance to receive the second elongated edge beam therebetween.

In one embodiment, the structural frame further includes a second tendon assembly extending between the second and third columns, the second tendon assembly being adapted to be tensioned to thereby compress the second elongated edge beam between the second and third columns.

In one embodiment, the structural frame further includes a perimeter beam having a length corresponding to the first distance between the first and second columns, the perimeter beam being adapted to be received between the first and second columns so as to be compressed between the first and second columns when the first tendon assembly is tensioned.

In one embodiment, the perimeter beam has a rectangular cross-section.

In one embodiment, each slab includes a plurality of ribs extending below the top face between opposite sides of the slab for providing rigidity to the slab.

In one embodiment, the plurality of ribs includes first and second parallel ribs and third and fourth parallel ribs extending perpendicularly to the first and second parallel ribs.

In one embodiment, the at least one left cable and the at least one right cable are made of structural steel.

In one embodiment, the at least one left cable and the at least one right cable include a pair of spaced-apart upper cables and a pair of spaced-apart lower cables located below the upper cables.

According to another aspect, there is also provided a method for constructing a structural frame for a building, the method including: providing a plurality of precast columns; positioning the columns so as to define a perimeter of the structural frame; providing a plurality of precast concrete floor slabs, each slab having opposite first and second sides and opposite third and fourth sides defining four corners therebetween, the floor slab further having first and second corner indents located in two adjacent corners, each corner indent being sized and shaped to receive one of the first and second columns, the first and second corner indents extending inwardly from the first side towards the second side to define an elongated edge beam therebetween, the elongated edge beam having a length corresponding to the first distance between the first and second columns, the elongated edge beam being disposed between the first and second columns such that the first and second columns are received in the first and second corner indents and that the elongated edge beam abuts the first and second columns; positioning the slabs horizontally adjacent each other to define a floor of the structural frame such that the elongated edge beams extend between two adjacent ones of the columns; providing at least one tendon assembly extending between the adjacent columns; tensioning the at least one tendon assembly to thereby compress the elongated edge beams between the adjacent columns.

In one embodiment, the method further comprises: applying grout over the at least one tensioned tendon assembly.

According to yet another aspect, there is further provided a kit for constructing a structural frame of a building, the kit comprising: a plurality of rectangular columns including a first column and a second column adapted to be disposed adjacent the first column such that the first and second columns are spaced from each other by a first distance; at least one precast concrete floor slab having opposite first and second sides and opposite third and fourth sides defining four corners therebetween, the floor slab further having first and second corner indents located in two adjacent corners, each corner indent being sized and shaped to receive one of the first and second columns, the first and second corner indents extending inwardly from the first side towards the second side to define a first elongated edge beam therebetween, the first elongated edge beam having a length corresponding to the first distance between the first and second columns, the first elongated edge beam being disposed between the first and second columns such that the first and second columns are received in the first and second corner indents and that the first elongated edge beam abuts the first and second columns; and a first tendon assembly adapted to extend between the first and second columns, the first tendon assembly being adapted to be tensioned to thereby compress the first elongated edge beam between the first and second columns.

BRIEF DESCRIPTION OF THE DRAWINGS

Having thus generally described the nature of the invention, reference will now be made to the accompanying drawings, showing by way of illustration a preferred embodiment thereof and in which.

Further details of the invention and its advantages will be apparent from the detailed description included below.

DETAILED DESCRIPTION OF EMBODIMENTS OF THE INVENTION

In the following description of the embodiments, references to the accompanying drawings are by way of illustration of an example by which the invention may be practiced. It will be understood that other embodiments may be made without departing from the scope of the invention disclosed.

Figure 1:
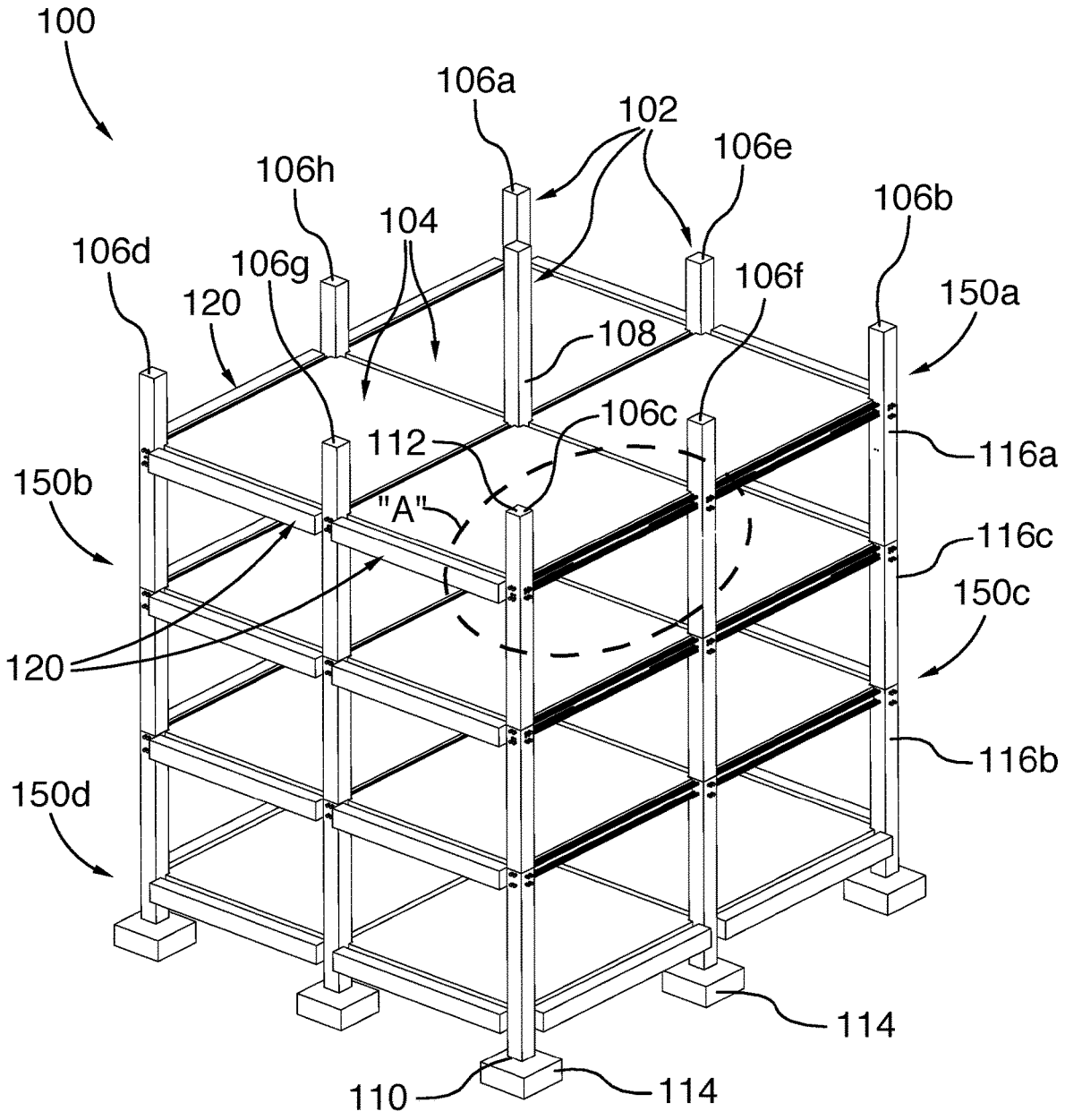
FIG. 1 is a perspective view of a structural frame for a building, in accordance with one embodiment, with right perimeter beams removed to better show structural steel tendon assemblies extending between perimeter columns.
Figure 2:
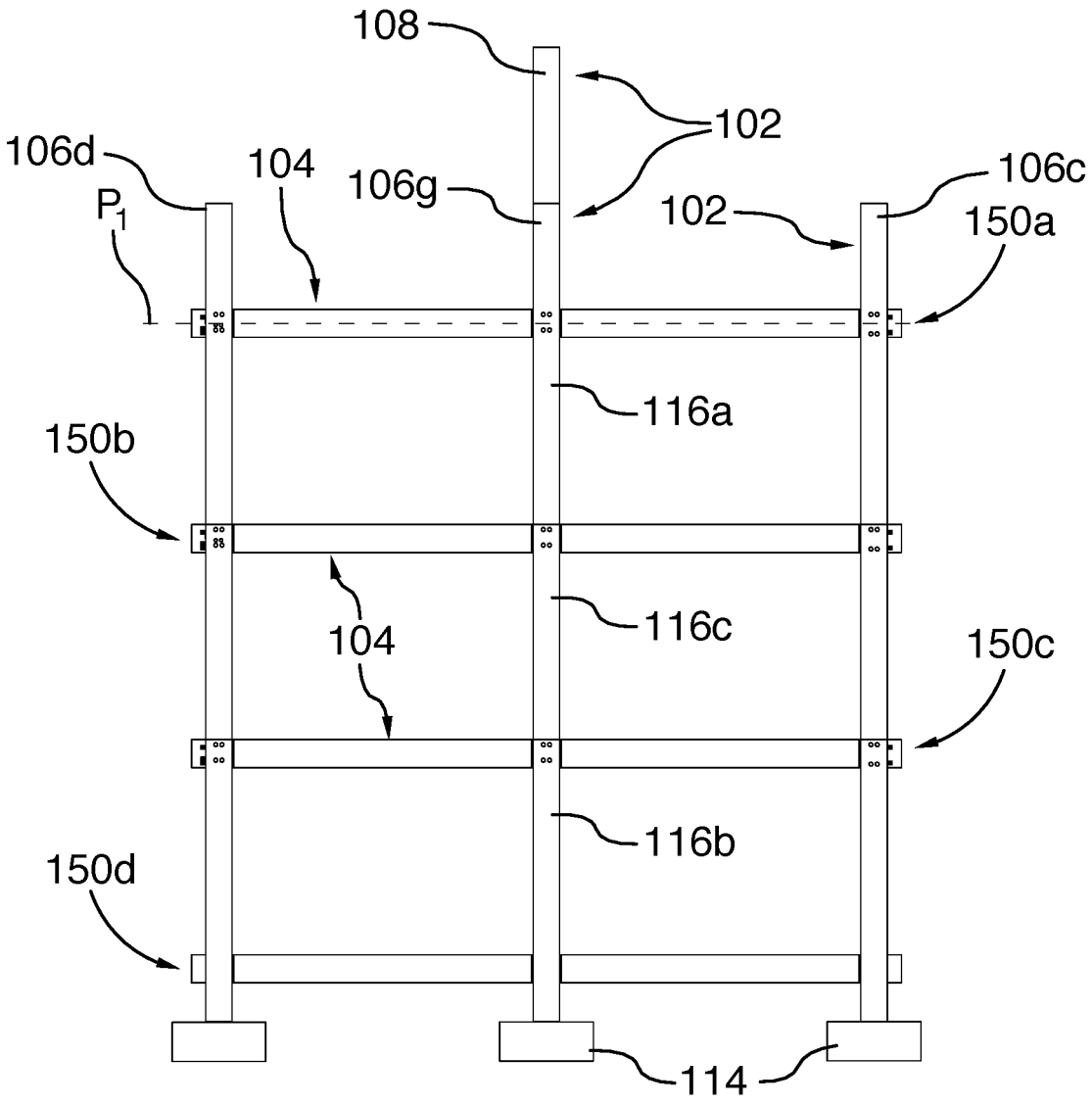
FIG. 2 is a front elevation view of the structural frame illustrated in FIG. 1.
Figure 3:
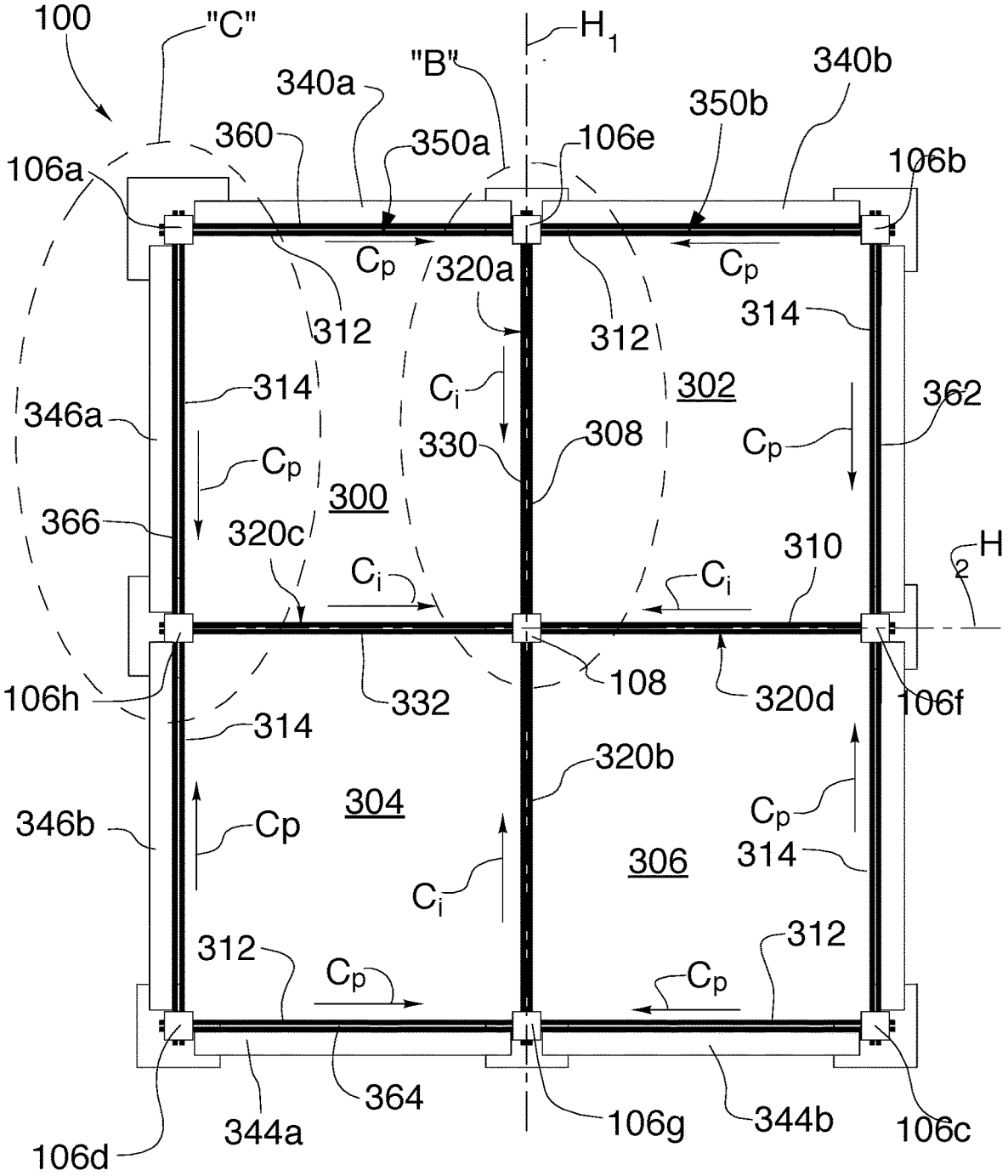
FIG. 3 is a top plan view of the structural frame illustrated in FIG. 1.

Referring first to FIGS. 1 to 3, there is provided a structural frame 100 for a building, in accordance with one embodiment. The structural frame 100 includes a plurality of spaced apart columns 102 and a plurality of horizontal floor slabs or slabs 104 disposed between the columns 102. Several slabs 104 are positioned at the same height above the ground to define a floor 150 of the building. In this embodiment, four (4) floors are shown, with each floor being made up of four (4) slabs arranged in a rectangular grid pattern.

It will be appreciated that the number of floors and the number of slabs making up each floor in this embodiment are illustrative only. The structural frame 100 is scalable such that in other alternative embodiments, the number of floors and slabs in each floor could be changed to suit a particular application.

Specifically, the plurality of columns 102 includes a plurality of spaced apart perimeter or edge columns, identified generically with reference numeral 106, disposed in a generally rectangular pattern along the outer edges of the structural frame 100 to define a perimeter of the building and a central column 108 located generally at a center between the perimeter columns 106.

The columns 106 include first, second, third and fourth corner columns 106*a*, 106*b*, 106*c*, 106*d* and first, second, third and fourth intermediate or side columns 106*e*, 106*f*, 106*g*, 106*h*. The first side column 106*e* is located generally halfway between the first and second corner columns 106*a*, 106*b*. The second side column 106*f* is located generally halfway between the second and third corner columns 106*b*, 106*c*. The third side column 106*g* located generally halfway between the third and fourth corner columns 106*c*, 106*d*. The fourth side column 106*h* located generally halfway between the fourth and first corner columns 106*d*, 106*a*. This embodiment therefore shows eight (8) perimeter columns 106. However, in other embodiments, a greater or lower number of columns may be used depending of the size of the structural frame and the number of slabs used.

Each column 102 includes a bottom end 110 and a top end 112 opposite the bottom end 110. In the illustrated embodiment, the bottom end 110 of the column 102 is secured to a column footing 114 which is positioned and buried under a ground surface. Alternatively, the bottom end 110 of the column 102 could be secured to another type of foundation structure which a skilled person would consider to be appropriate.

In one embodiment, the columns 102 are made of precast concrete. Alternatively, the columns 102 may be made of a different structural material having generally the same properties as precast concrete.

Preferably, each column 102 has a square cross-section area that measures between about 340 mm by 340 mm to about 500 mm by 500 mm. Alternatively, the columns 102 could be fabricated with different dimensions and could have a rectangular cross-section or any other cross-section that a skilled addressee would consider to be appropriate.

In the illustrated embodiment, each column 102 is made of a plurality of column portions, generally identified with the reference numeral 116, which are disposed or stacked on top of each other. It will be appreciated that this configuration enables additional column portions to be easily added on top of the columns 102 to add additional floors to the structural frame. In this embodiment, the plurality of column portions includes three column portions—a top column portion 116*a*, a bottom column portion 116*b* and a middle column portion 116*c* extending between the top and bottom column portions 116*a*, 116*b*. In another embodiment, the columns 102 could include a different number of column portions, and/or the column portions could have various heights and configurations. For example, some or all columns in the structural frame 100 could be one, two or three stories high. It will be understood that the height of a column portion could be selected according to various factors such as the height of the building, requirements related to the transportation of the column portions and the lifting capacity of a crane or cranes used to assemble the structural frame 100.

In the illustrated embodiment, the column portions 116*a*, 116*b*, 116*b* are further connected together to form a single, elongated body. More specifically, the top column portion 116*a* could be secured to the middle column portion 116 by vertical rebar, not shown, extending between the top column portion 116*a* and the middle column portion 116 within the column portions 116*a*, 116*c*. The middle column portion 116*c* could be secured to the bottom column portion 116*b* in a similar manner. Alternatively, the column portions 116*a*, 116*b*, 116*c* could be secured together using other securing techniques which a skilled addressee would consider to be appropriate.

Still referring to FIGS. 1 to 3, the floors 150 include four floors—a top floor 150*a*, an upper intermediate floor 150*b*, a lower intermediate floor 150*c* and a bottom floor 150*d*.

In the following description, only the top floor 150*a* will be described, the upper intermediate, lower intermediate and bottom floors 150*b*, 150*c*, 150*d* being generally similar to the top floor 150*a*.

The top floor 150*a* includes first, second, third and fourth slabs 300, 302, 304, 306 disposed generally adjacent each other in a two-by-two grid configuration in a common top floor plane $P_1$. Each slab 300, 302, 304, 306 is generally rectangular and includes first and second inner sides 308, 310 which extend perpendicularly to each other and first and second outer sides 312, 314 which also extend perpendicularly to each other. The first and second inner sides 308, 310 of each slab 300, 302, 304, 306 are located towards the other slabs 300, 302, 304, 306, while the first and second outer sides 312, 314 are located away from the other slabs 300, 302, 304, 306 and towards an exterior of the structural frame 100. For example, the first and second inner sides 308, 310 of the first slab 300 are located respectively towards the second and third slabs 302, 304 which are located next to the first slab 300.

It will be appreciated that in this configuration, the slabs 300, 302, 304, 306 are mirror images of each other about a first horizontal central axis $H_1$ extending between the first and third side columns 106*e*, 106*g*, and are also mirror images of each other about a second horizontal central axis $H_1$ extending between the second and fourth side columns 106*f*, 106*h*, as shown in FIG. 3.

Figure 4:
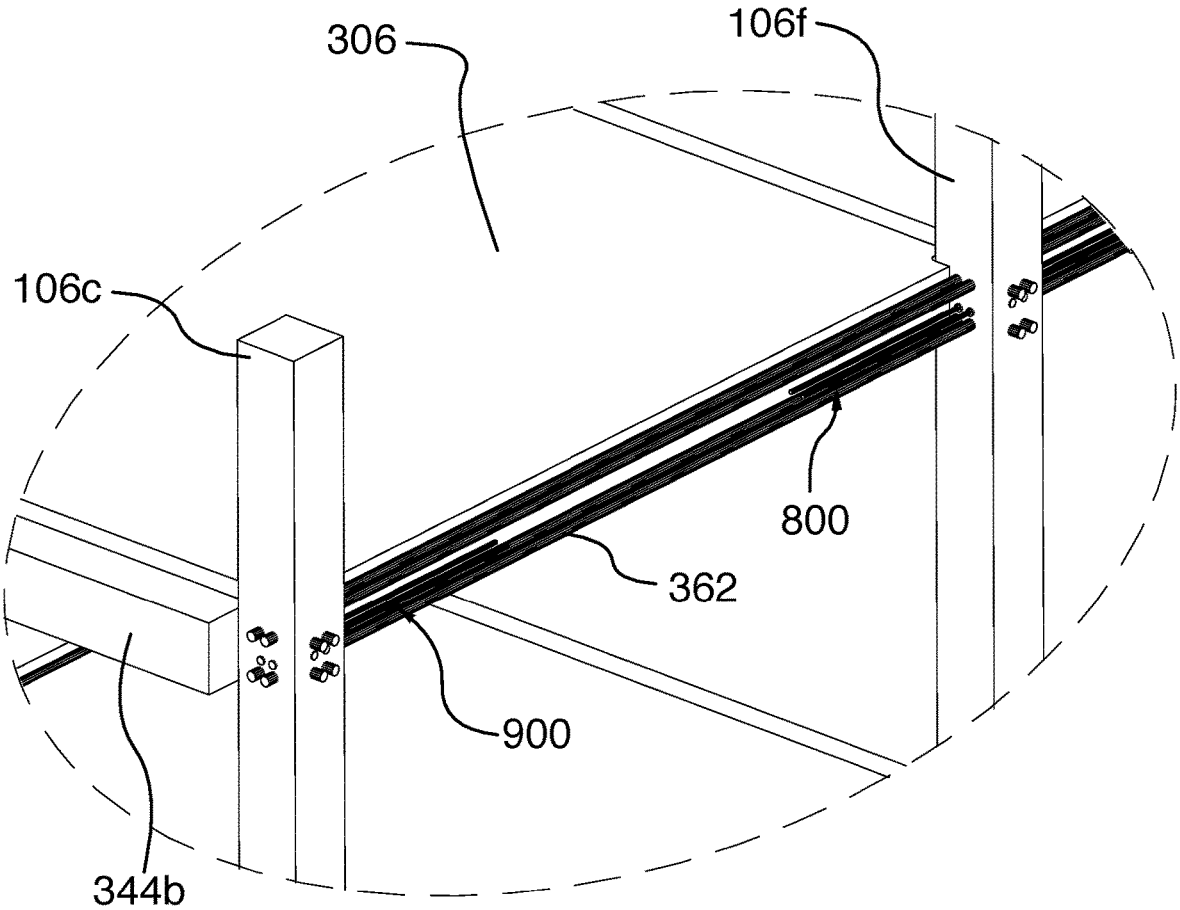
FIG. 4 is an enlarged perspective view of portion "A" of the structural frame illustrated in FIG. 1, showing details of the tendon assemblies extending between two adjacent perimeter columns.
Figure 5:
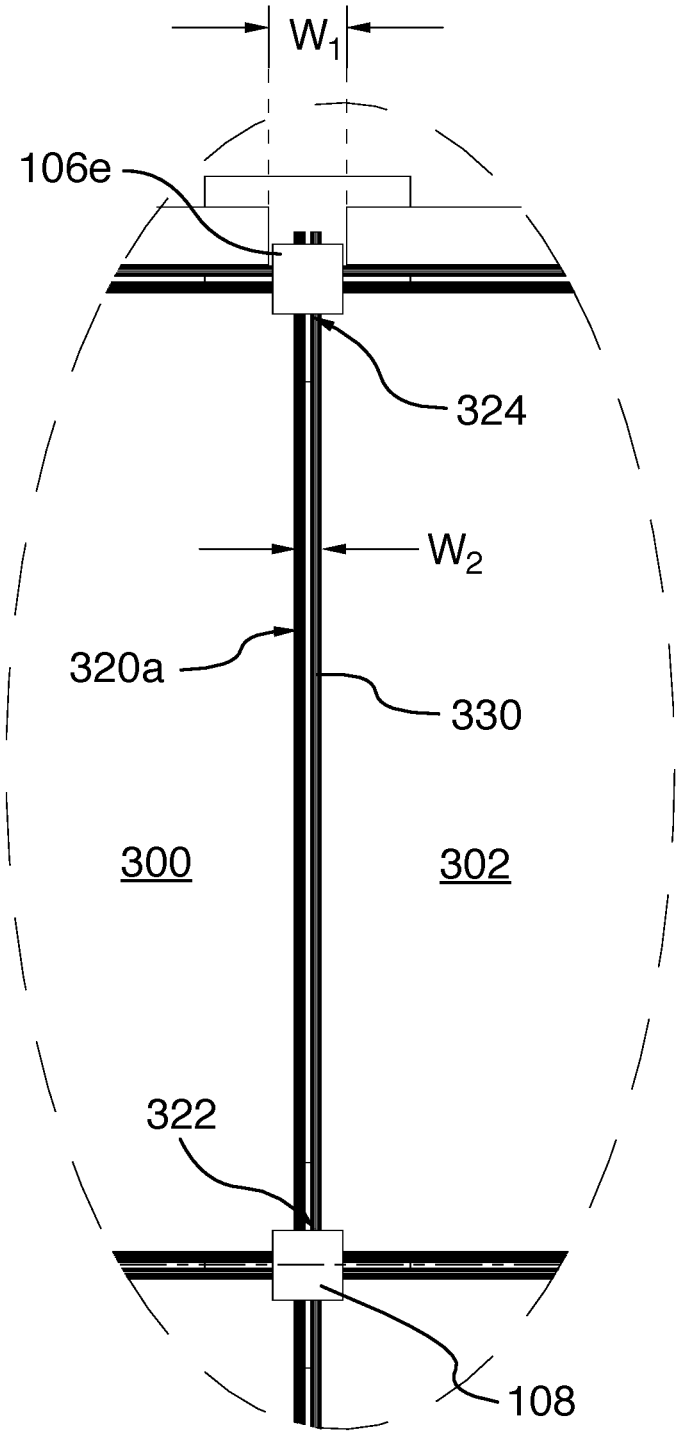
FIG. 5 is an enlarged top plan view of portion "B" of the structural frame illustrated in FIG. 3, provided to better show the tendon assemblies extending in the inner elongated spaces between adjacent slabs.

Now referring to FIGS. 3 to 5, the slabs 300, 302, 304, 306 are further spaced from each other to define a plurality of inner elongated spaces, identified generically with reference numeral 320, between adjacent slabs 300, 302, 304, 306. More specifically, the plurality of elongated spaces 320 includes a first elongated space 320*a* defined between the first and second slabs 300, 302, a second elongated space 320*b* defined between the third and fourth slabs 304, 306, a third elongated space 320*c* defined between the first and third slabs 300, 304 and a fourth elongated space 320*d* defined between the second and fourth slabs 302, 306.

As shown in FIG. 3, the first and second elongated spaces 320*a*, 320*b* are aligned with each other and extend along the first horizontal central axis $H_1$. The third and fourth elongated spaces 320*c*, 320*d* are also aligned with each other and extend along the second horizontal central axis $H_2$, and therefore perpendicularly to the first and second elongated spaces 320*a*, 320*b*.

When seen from above, the elongated spaces 320 therefore radiate outwardly from the central column 108 towards the side columns 106*e*, 106*f*, 106*g*, 106*h*. Specifically, each elongated space 320*a*, 320*b*, 320*c* or 320*d* has an inner end 322 located adjacent the central column 108 and an outer end 324 located adjacent a corresponding one of the side columns 106*e*, 106*f*, 106*g* or 106*h*. For example, the inner end 322 of the first elongated space 320*a* is located adjacent the central column 108 while the outer end 324 of the first elongated space 320*a* is located near the first side column 106*e*.

In the illustrated embodiment, the structural frame 100 further includes a first inner tendon assembly 330 and a second inner tendon assembly 332 which extend within the elongated spaces 320*a*, 320*b*, 320*c*, 320*d* between opposite side columns 106*e*, 106*f*, 106*g*, 106*h*. The inner tendon assemblies 330, 332 are elongated structural elements, such as cables, which are adapted to be tensioned to compress the slabs 104 between the columns 102 and thereby tie the slabs 104 together, as will be explained further below.

More specifically, the first inner tendon assembly 330 extends generally parallel to the top floor plane $P_1$ between the first side column 106*e* and the third side column 106*g*. The first inner tendon assembly 330 is received within the first and second elongated spaces 320*a*, 320*b* and extends through the central column 108, generally along the first horizontal central axis $H_1$. Specifically, the central column 108 includes a first horizontal opening, not shown, which is aligned with the first and second elongated spaces 320*a*, 320*b* and which allows the first inner tendon assembly 330 to pass through.

The second inner tendon assembly 332 extends generally parallel to the top floor plane $P_1$ between the second side column 106*f* and the fourth side column 106*h*. The second inner tendon assembly 332 is received within the third and fourth elongated spaces 320*c*, 320*d* and extends through the central column 108, generally along the second horizontal central axis $H_2$. The central column 108 further includes a second horizontal opening, not shown, which is aligned with the first and second elongated spaces 320*a*, 320*b* and which allows the second inner tendon assembly 332 to pass through.

Specifically, the inner tendon assemblies 330, 332 are secured to the opposite side columns 106*e*, 106*g* or 106*f*, 106*h* and are tensioned to create a force, represented in FIG. 3 by arrows $C_i$, from the opposite side columns 106*e*, 106*g* or 106*f*, 106*h* towards each other and towards the center column 108.

As best shown in FIG. 5, the columns 102 have a first width $W_1$ and the elongated spaces have a second width $W_2$ which is less than the first width $W_1$ such that the slabs 300, 302, 304, 306 project at least partially towards each other between the side columns 106*e*, 106*f*, 106*g*, 106*h* and the central column 108.

According to this configuration, when the inner tendon assemblies 330, 332 are tensioned, the slabs 300, 302, 304, 306 are compressed between the columns 102. In this configuration, the slabs 300, 302, 304, 306 are therefore held tightly between the columns 102 and thereby prevented from moving. It will also be appreciated that the compression created by the tendon assemblies on the slabs 300, 302, 304, 306 will further reduce or even eliminate the bending in the slabs 300, 302, 304, 306, especially at or around the interface between the slabs 300, 302, 304, 306 and the columns 102.

Alternatively, instead of being secured to opposite side columns 106*e*, 106*g* or 106*f*, 106*h*, each one of the first and second inner tendon assemblies 330, 332 could include a first tendon assembly portion extending between the central column 108 and a first side column 106*e*, 106*f*, 106*g* or 106*h* and a second tendon assembly portion extending between the central column 108 and a second side column 106*e*, 106*f*, 106*g* or 106*h* opposite the first side column 106*e*, 106*f*, 106*g* or 106*h*.

Referring to FIGS. 1 to 6, the structural frame 100 further includes a plurality of perimeter beams 120 which extends in the top floor plane $P_1$ parallel to and spaced from the outer sides 312, 314 of the slabs 300, 302, 304, 306. As best shown in FIG. 3, the plurality of perimeter beams 120 include first and second perimeter beams 340*a*, 340*b* spaced from the first outer side 312 of the first and second slabs 300, 302 respectively, third and fourth perimeter beams, not shown, spaced from the second outer side 314 of the second and fourth slabs 302, 306 respectively, fifth and sixth perimeter beams 344*a*, 344*b* spaced from the first outer side 312 of the third and fourth slabs 304, 306 respectively and seventh and eighth perimeter beams 346*a*, 346*b* spaced from the second outer side 312 of the first and third slabs 300, 304 respectively.

In the illustrated embodiment, each perimeter beam 120 further has a generally rectangular cross-section. Alternatively, the perimeter beams 120 could have any other cross-sectional shape that a skilled person would consider to be appropriate. For example, the shape and configuration of perimeter beams 120 could be selected in order to accommodate a desired exterior cladding or other exterior architectural elements of the building.

Moreover, the perimeter beam may be made of precast concrete, but could alternatively be made of a similar material having similar properties as precast concrete.

Still in the illustrated embodiment, each perimeter beam 120 is parallel to, and spaced apart from, a corresponding outer side 312 or 314 and is spaced from the corresponding outer side 312 or 314 to define a perimeter elongated space between the corresponding slab 300, 302, 304, 306 and the perimeter beam 120. For example, the first perimeter beam 340*a* is spaced from the first outer side 312 of the first slab 300 to define a first perimeter elongated space 350*a* and the second perimeter beam 340*b* is spaced from the first outer side 312 of the second slab 302 to define a second perimeter elongated space 350*b*.

The perimeter elongated spaces 340*a*, 340*b* are generally similar to the inner elongated spaces 320*a*, 320*b*, 320*c*, 320*d* and are adapted to receive a plurality of perimeter tendon assemblies—first, second, third and fourth tendon assemblies 360, 362, 364, 366—extending generally parallel to the top floor plane $P_1$ between corner columns 106*a*, 106*b*, 106*c*, 106*d* through side columns 106*e*, 106*f*, 106*g*, 106*h*. For example, the first perimeter elongated space 350*a* and the second perimeter elongated space 350*b* are aligned with each other and are adapted to receive the first perimeter tendon assembly 360 which extends between the first corner column 106*a* and the second corner column 106*b*.

As best shown in FIG. 3, the second perimeter tendon assembly 362 extends between the second corner column 106*b* and the third corner column 106*c*. The third perimeter tendon assembly 364 extends between the third corner column 106*c* and the fourth corner column 106*d*. The fourth perimeter tendon assembly 366 extends between the fourth corner column 106*d* and the first perimeter column 106*a*. The first, second, third and fourth perimeter tendon assemblies 360, 362, 364, 366 further extend respectively through the first, second, third and fourth side columns 106*e*, 106*f*, 106*g*, 106*h*.

The perimeter tendon assemblies 360, 362, 364, 366 are substantially similar to the inner tendon assemblies 330, 332 and are adapted to be tensioned to create a compressive force field, represented in FIG. 3 by arrows $C_p$, along the floor's perimeter from opposite corner columns 106*a*, 106*b*, 106*c*, 106*d* towards each other and towards the corresponding side column 106*e*, 106*f*, 106*g* or 106*h* located between the corner columns 106*a*, 106*b*, 106*c*, 106*d*.

Moreover, both the slabs 104 and the perimeter beams 120 are sized and shaped so as to be partially received between adjacent perimeter columns 106. In this configuration, the perimeter elongated spaces 350 therefore have a third width $W_3$ which is less than the first width $W_1$ of the columns 102.

Figure 6:
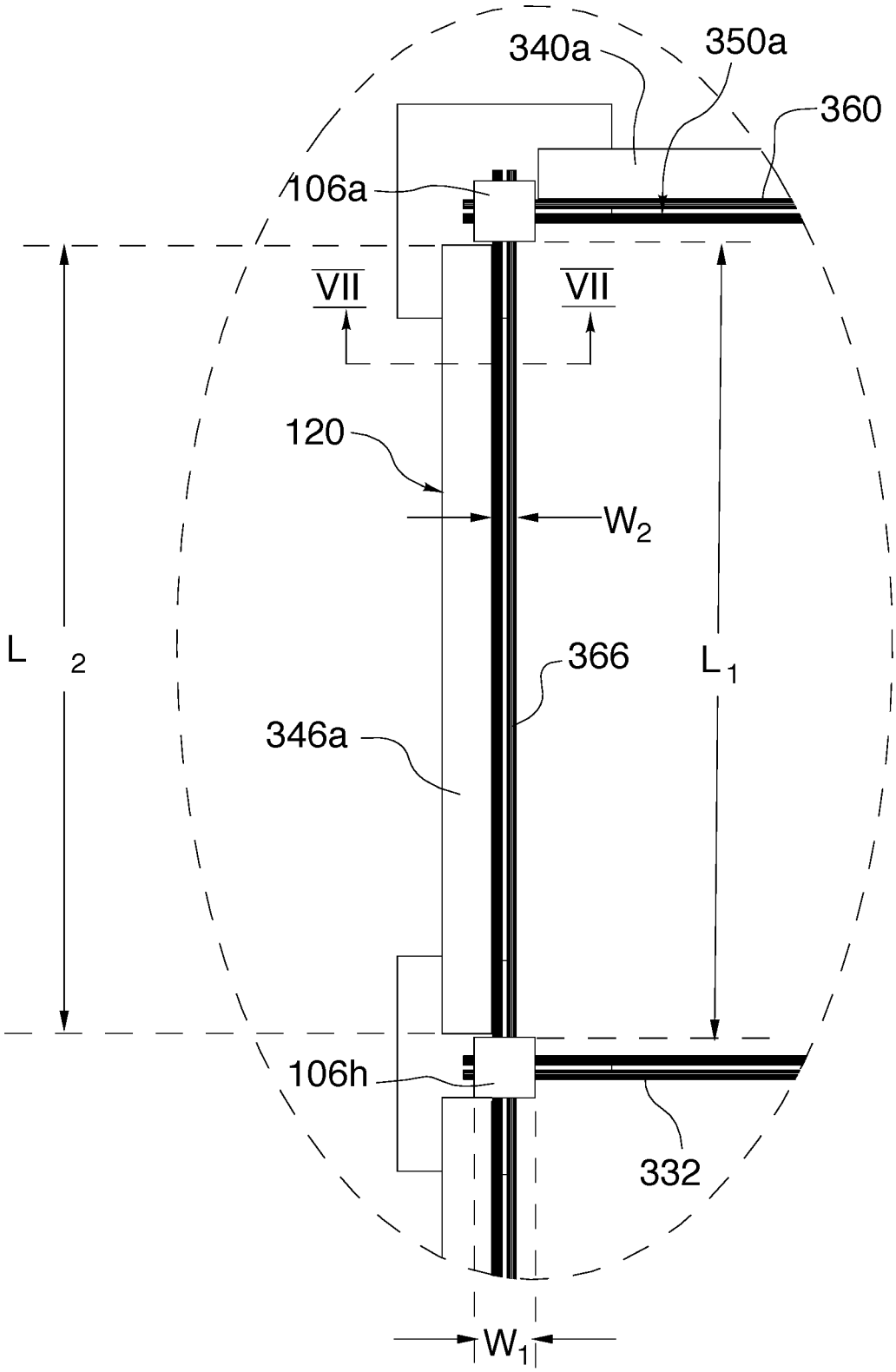
FIG. 6 is another enlarged top plan view of portion "C" of the structural frame illustrated in FIG. 3, to better show the tendon assemblies extending in the outer elongated spaces between the slabs and perimeter beams adjacent the slabs.

As best shown in FIG. 6, the slabs 300, 302, 304, 306 project at least partially towards the perimeter beams 120 between the corner columns 106*a*, 106*b*, 106*c*, 106*d* and the side columns 106*e*, 106*f*, 106*g*, 106*h*.

As further shown in FIG. 6, all of the side columns 106*e*, 106*f*, 106*g*, 106*h* are spaced from adjacent corner columns 106*a*, 106*b*, 106*c* or 106*d* by the same distance $L_1$. Each perimeter beam 120 has a length $L_2$ which is substantially equal to the distance $L_1$ between adjacent perimeter columns 106*a*, 106*b*, 106*c*, 106*d*, 106*e*, 106*f*, 106*g*, 106*h*, which allows the perimeter beam 120 to also be partially received between adjacent perimeter columns 106.

When the perimeter tendon assemblies 360, 362, 364, 366 are tensioned, the slabs 300, 302, 304, 306 and the perimeter beams 120 are compressed between the columns 106. In this configuration, the slabs 300, 302, 304, 306 and the perimeter beams 120 are therefore held tightly between the columns 106 and thereby prevented from moving by friction of the slabs 300, 302, 304, 306 and the perimeter beams 120 against the columns 106. It will also be appreciated that the compression created by the tendon assemblies on the slabs 300, 302, 304, 306 and the perimeter beams 120 will further reduce or even eliminate the bending in the slabs 300, 302, 304, 306, especially at or around the interface between the slabs 300, 302, 304, 306 and the columns 102.

In one embodiment, instead of including four tendon assemblies 360, 362, 364, 366 which extend along the entire width of the floor 150 between corner columns 106*a*, 106*b*, 106*c*, 106*d*, each perimeter tendon assembly 360, 362, 364, 366 could include a first tendon assembly portion which extends between one of the side columns 106*e*, 106*f*, 106*g* or 106*h* and one of the corner columns 106*a*, 106*b*, 106*c* or 106*d* adjacent the side column 106*e*, 106*f*, 106*g* or 106*h*.

Figure 7:
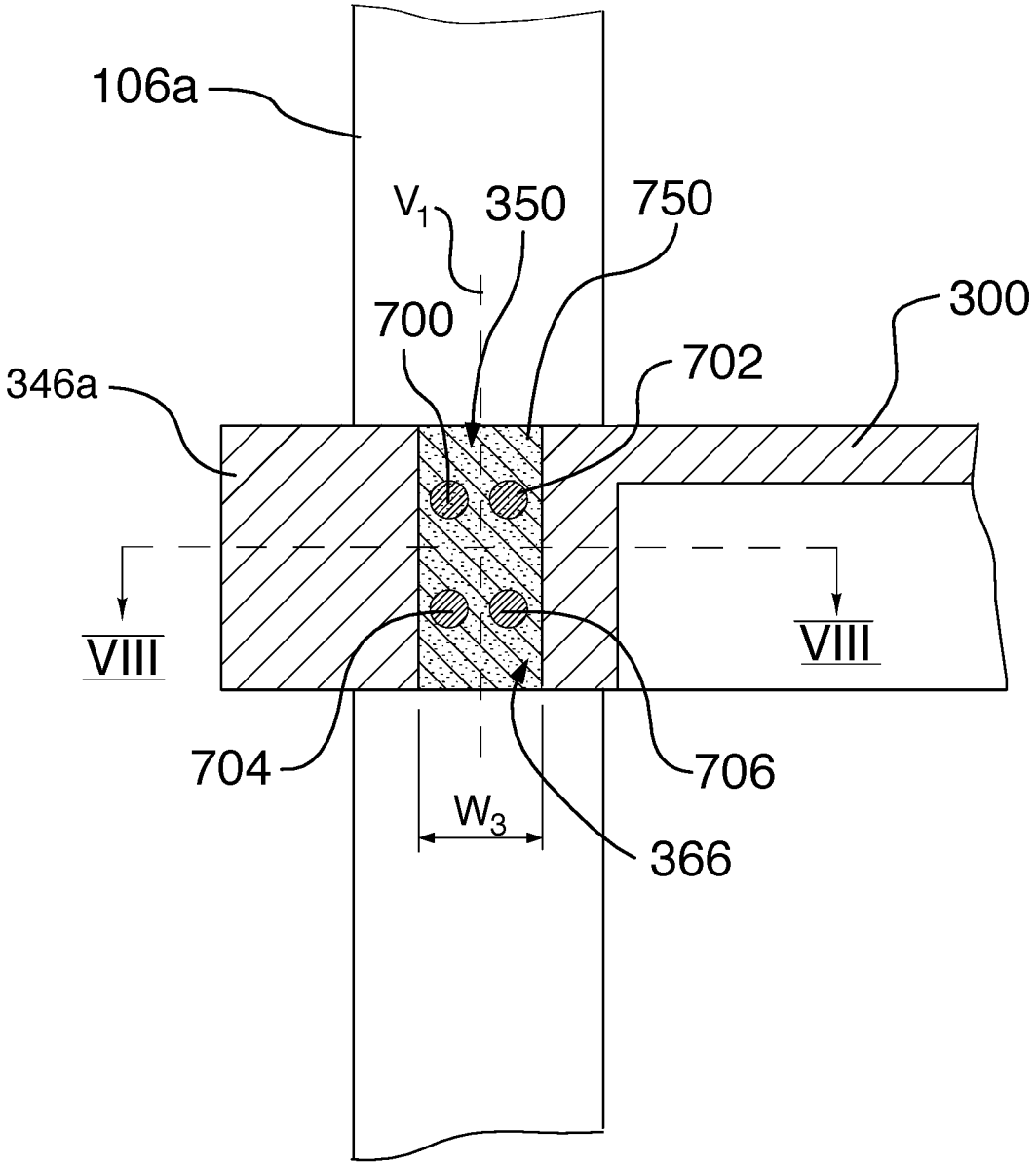
FIG. 7 is an enlarged cross-sectional view of the structural frame illustrated in FIG. 6, taken along cross-section line VII-VII, with grout provided in the outer elongated space.

Turning now to FIG. 7, each tendon assembly 330, 332, 360, 362, 364, 366 could include a plurality of cables 700, 702, 704, 706 extending parallel to each other. For example, the fourth perimeter tendon assembly 366 includes a pair of spaced-apart upper cables 700, 702 and a pair of spaced-apart lower cables 704, 706 located below the upper cables 700, 702. The upper and lower cables 700, 702, 704, 706 thereby form a rectangular pattern, as illustrated in FIG. 7. Specifically, the upper cables 700, 702 are generally symmetrically disposed at an equal distance from a vertical center plane $V_1$ of the elongated space 350 and of the corresponding column 102. The center plane $V_1$ extends longitudinally along the elongated space and is located generally midway across the third width $W_3$ of the elongated space 350. Similarly, the lower cables 704, 706 are also generally symmetrically disposed at an equal distance from the vertical center plane $V_1$ on either side of the vertical center plane $V_1$.

Alternatively, each tendon assembly 330, 332, 360, 362, 364, 366 could include a different number of cables disposed in one of various other patterns. For example, each tendon assembly 330, 332, 360, 362, 364, 366 could include only two cables—a left cable and a right cable—located symmetrically on either sides of the vertical center plane $V_1$.

In the illustrated embodiment, the tendon assemblies 330, 332, 360, 362, 364, 366 include structural steel cables. Preferably, each cable has a diameter between 15 mm and 20 mm.

Alternatively, the tendon assemblies 330, 332, 360, 362, 364, 366 could include wire, threaded rods or any other type of tendon assemblies which a skilled person would consider to be appropriate.

Turning now to FIGS. 10 to 14, each slab 104 includes a planar top face 1000 which defines a slab plane $P_2$ and a plurality of ribs 1100, 1102, 1104, 1106 extending below the top face 1000 between opposite sides of the slab 104 for providing rigidity to the slab 104. More specifically, each slab 104 includes first and second parallel ribs 1100, 1102 extending between the first inner side 308 and the second outer side 314 of the slab 104 and third and fourth parallel ribs 1104, 1106 extending between the second inner side 310 and the first outer side 312. In this configuration, the first and second parallel ribs 1100, 1102 are therefore perpendicular to the third and fourth parallel ribs 1104, 1106.

It will be appreciated that this configuration provides structural strength and improves the slab's resistance to bending, while reducing the weight of the slabs. This configuration further reduces the amount of material required to manufacture the slabs, and therefore the cost of manufacturing the slabs.

Still referring to FIGS. 10 to 14, each slab further includes first, second, third and fourth corner indents 1002, 1004, 1006, 1008 which are each sized and shaped to receive a corresponding column.

Figure 13:
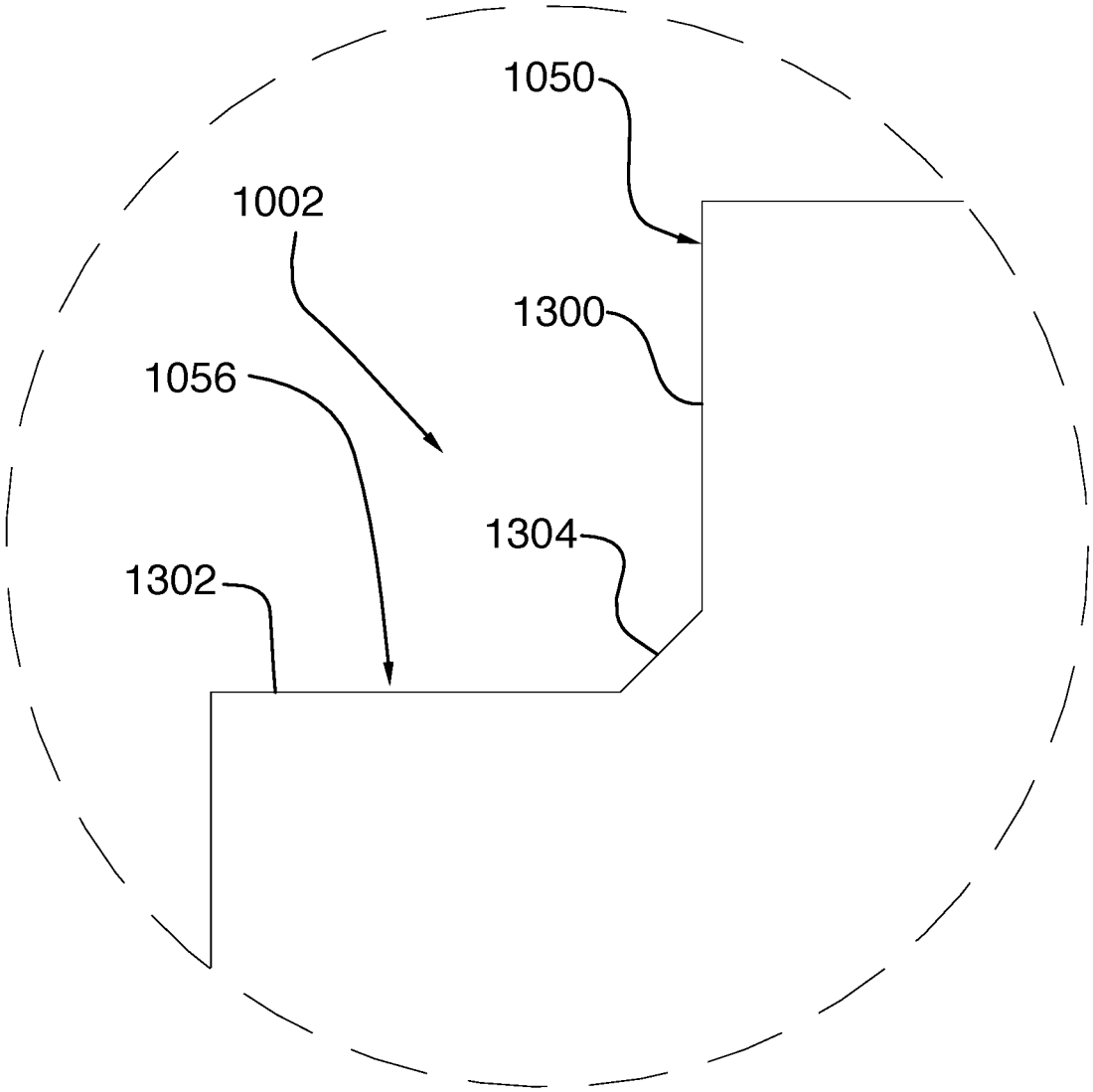
FIG. 13 is an enlarged top plan view of portion "D" of the slab illustrated in FIG. 12, showing details of a corner indent of the slab.
Figure 14:
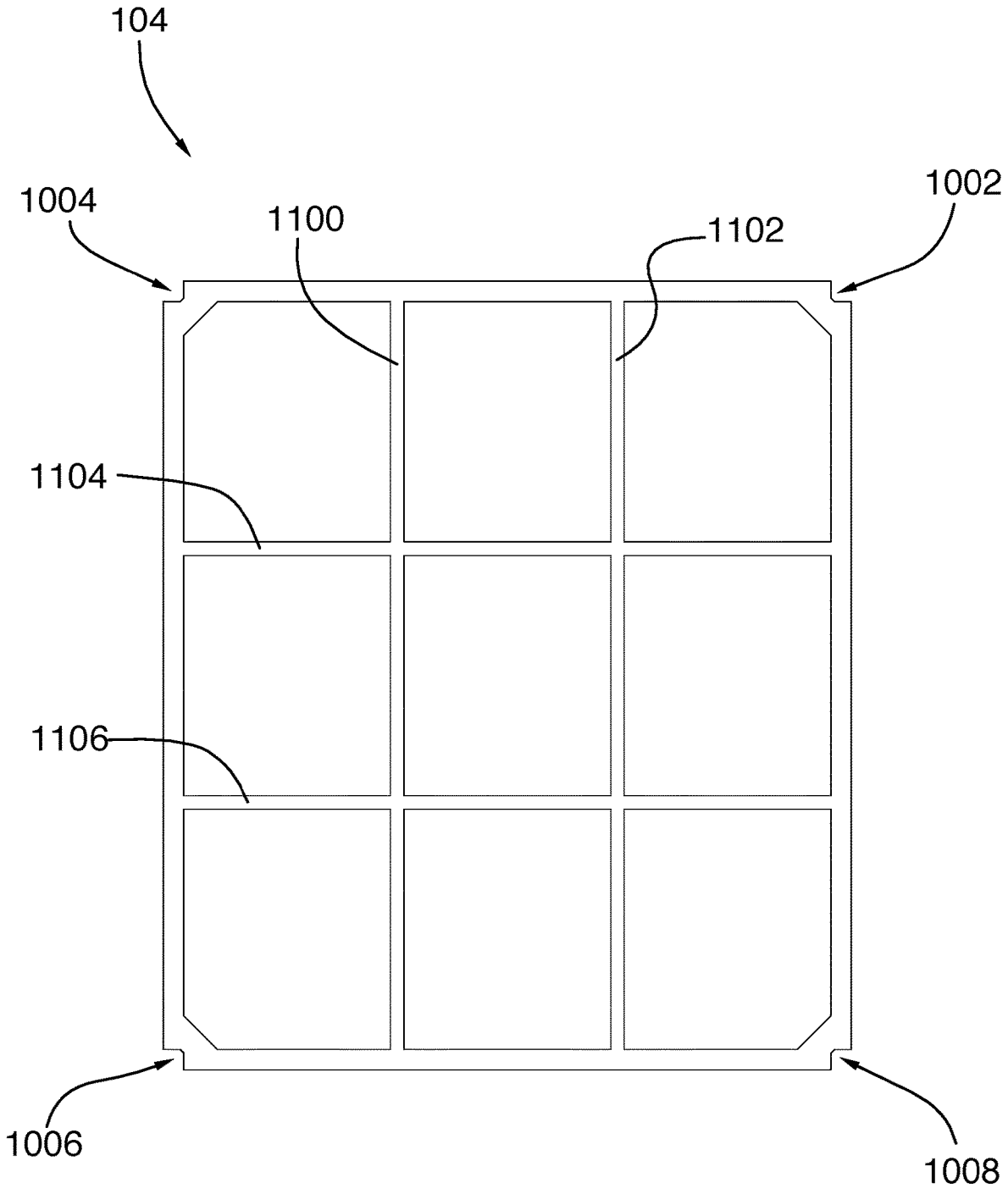
FIG. 14 is a bottom plan view of the slab illustrated in FIG. 10.

Referring specifically to FIG. 13, each corner indent 1002, 1004, 1006, 1008 includes perpendicular first and second side edges 1300, 1302 adapted to abut a corresponding column and a chamfered inner edge 1304 extending at an angle between the first and second side edges 1300, 1302.

The slab 104 further includes four rectangular, elongated edge beams 1050, 1052, 1054, 1056 defined between the corner indents 1002, 1004, 1006, 1008. The elongated edge beams 1050, 1052, 1054, 1056 extend outwardly from the slab 104, along the slab plane $P_2$. Specifically, a first elongated edge beam 1050 is defined between the first and second corner indents 1002, 1004, a second elongated edge beam 1052 is defined between the second and third corner indents 1004, 1006, a third elongated edge beam 1054 is defined between the third and fourth corner indents 1006, 1008 and a fourth elongated edge beam 1056 is defined between the fourth and first corner indents 1008, 1002.

It will be appreciated that the elongated edge beams 1050, 1052, 1054, 1056, similarly to the perimeter beams 120, are sized and shaped to be received between adjacent columns. Specifically, the elongated edge beams 1050, 1052, 1054, 1056 have a length $L_3$ which is similar to the distance $L_1$ between adjacent columns 102. It will also be appreciated that the elongated edge beams 1050, 1052, 1054, 1056, being integrally formed with the rest of the slab 104, permits a sturdier connection to the columns than if the slabs 104 were simply rectangular shaped and provided with separate edge beams. Separate edge beams would need to be secured themselves to the slabs 104, which implies the use of additional parts such as fasteners and which may create stress concentration areas in the slab 104.

To construct the frame 100, the columns 102 are first provided and positioned vertically in a desired box pattern relative to each other so as to define a perimeter of the structural frame.

The prefabricated slabs are then provided and positioned to define one or more floors, with the elongated edge beams 1050, 1052, 1054, 1056 being positioned between adjacent columns.

The tendon assemblies can then be provided between the columns 102 and tensioned as described above to thereby compress the elongated edge beams between the adjacent columns and create a robust, solid structural frame.

Referring back to FIG. 7, once the tendon assemblies have been tensioned, grout 750 can be poured in the inner elongated spaces and the perimeter elongated spaces to fill in the inner elongated spaces or perimeter elongated spaces. Before pouring the grout 750, a temporary bottom plate made of metal or wood can be installed between the slab and the perimeter beam to form a closed form to receive the grout 750. Once the grout 750 has been poured and cured, the temporary bottom plate can be removed.

It will be appreciated that when poured and cured, the grout 750 will encase the tendon assemblies and will protect the tendon assemblies 330, 332, 360, 362, 364, 366 against damage from fire, corrosion and the like. The grout 750 could include high strength grout such as fast hardening, early strength micro-expansion grout or any other type of grout that a skilled person would consider to be appropriate.

It will further be appreciated that the tensioning of the tendon assemblies tends to create a compressive stress field at the contact interface between the precast concrete columns and precast slabs which tends to prevent cracks from forming in the cured grout. This may potentially increase the service life and reliability of the structure.

Figure 8:
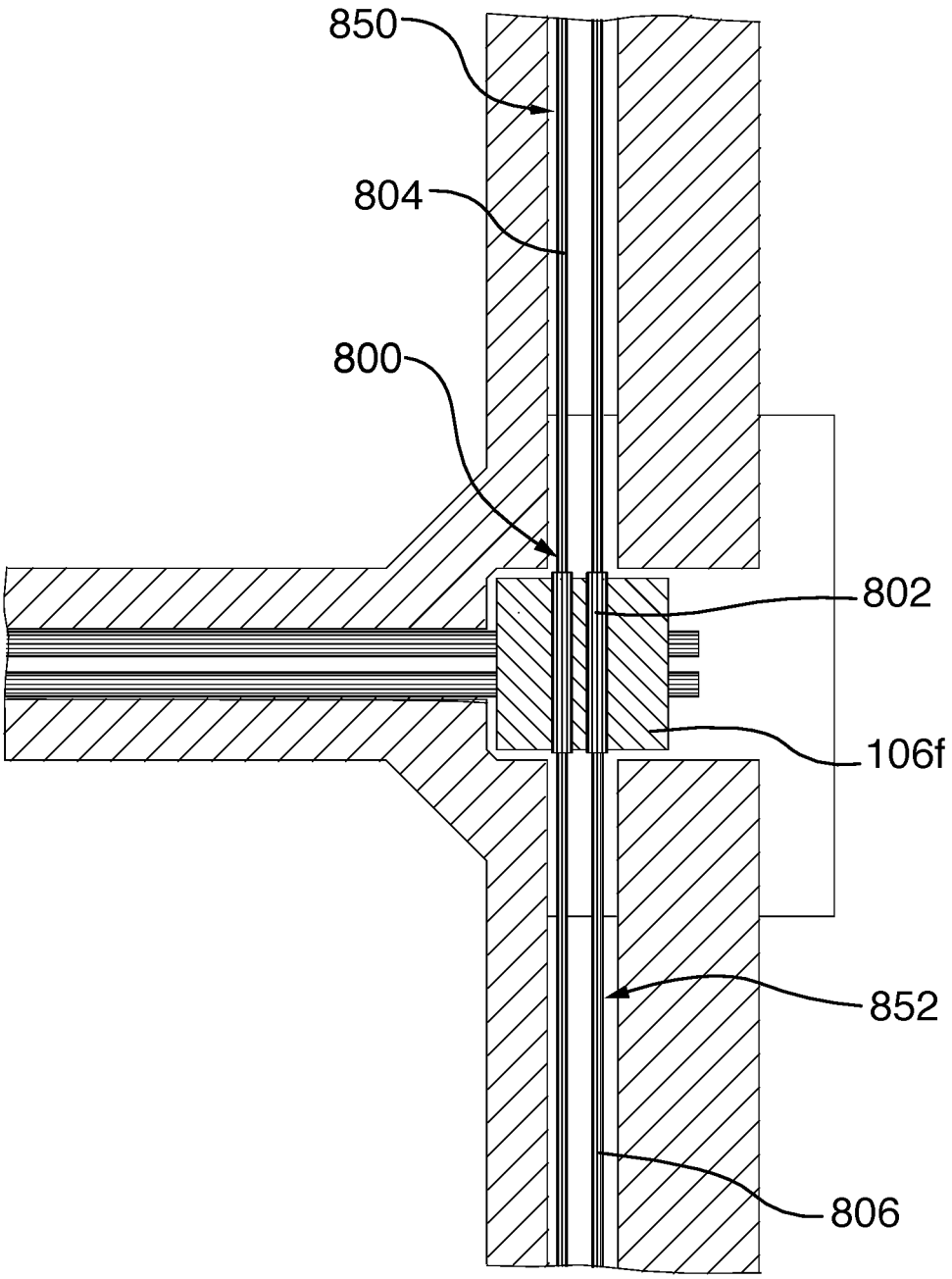
FIG. 8 is a cross-sectional view of a side column of the structural frame shown in FIG. 7, taken along cross-section line VIII-VIII, enlarged to show details of a side column reinforcement member.

Referring to FIGS. 4 and 8, the structural frame 100 may further include a plurality of side column reinforcement members 800 adapted to anchor the side columns **106*e*, 106*f*, 106*g*, 106*h* to the cured grout in the adjacent perimeter elongated spaces 350. Each side column reinforcement member 800 includes a female connector 802 which extends through the corresponding side column 106*e*, 106*f*, 106*g* or 106*h*, a first rod portion 804 extending into a first perimeter elongated space 850 and a second rod portion 806 extending into a second adjacent perimeter elongated space 852 opposite the first adjacent perimeter elongated space 850. The female connector 802 could include a standard female coupler and the first and second rod portions 804, 806 could include standard reinforcement bars or rebars adapted to engage the female connector 802. When the grout 750 is poured in the first and second adjacent elongated perimeter spaces 850, 852, it sets around the first and second rod portions 804, 806 and therefore forms a secure connection with the side column 106*e*, 106*f*, 106*g* or 106*h*, thereby preventing the grouting from moving longitudinally away from the side columns 106*e*, 106*f*, 106*g* or 106*h***.

Figure 9:
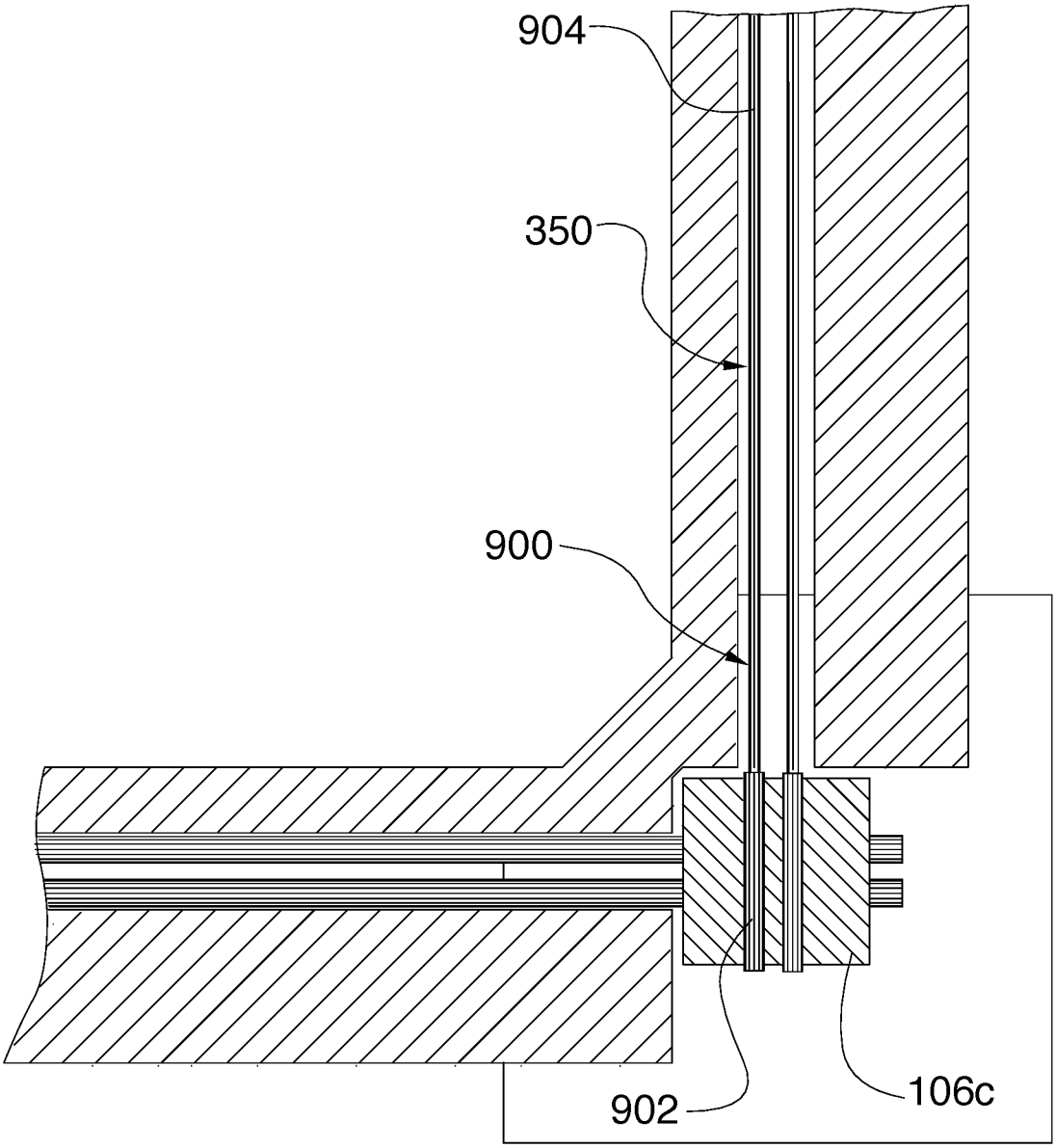
FIG. 9 is a cross-sectional view of a corner column of the structural frame illustrated in FIG. 1, taken along cross-section lines IX-IX, enlarged to show details of a corner column reinforcement member.
Figure 10:
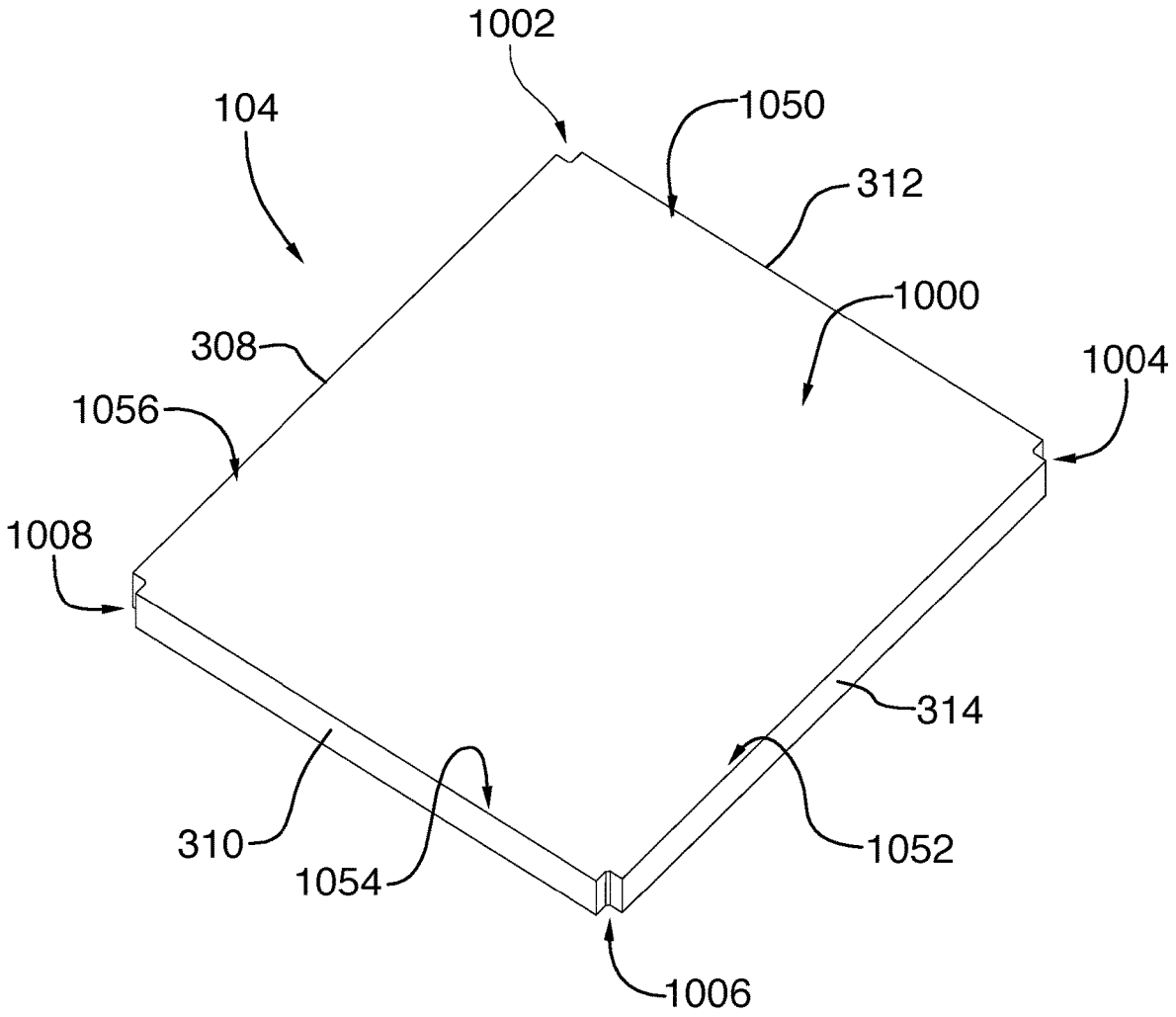
FIG. 10 is a top perspective view of a slab for the structural frame illustrated in FIG. 1.
Figure 11:
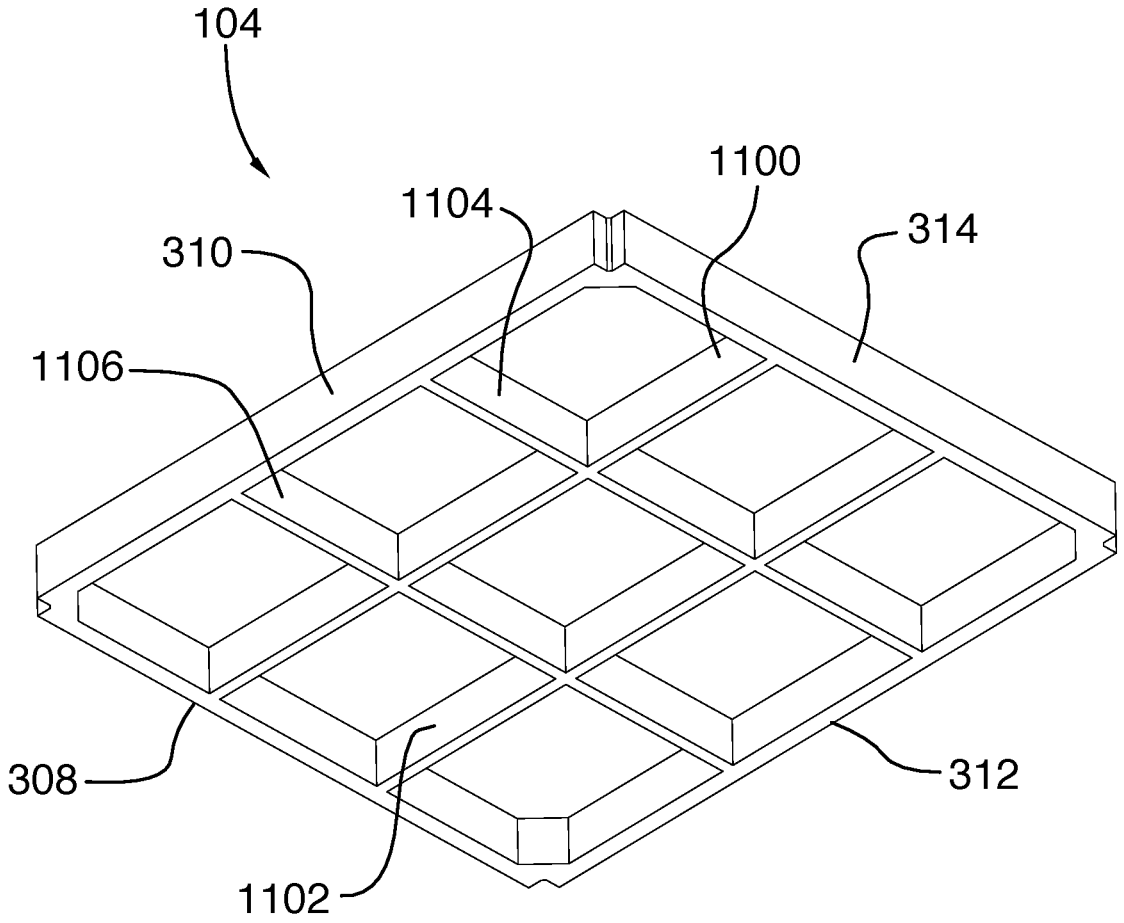
FIG. 11 is a bottom perspective view of the slab illustrated in FIG. 10.
Figure 12:
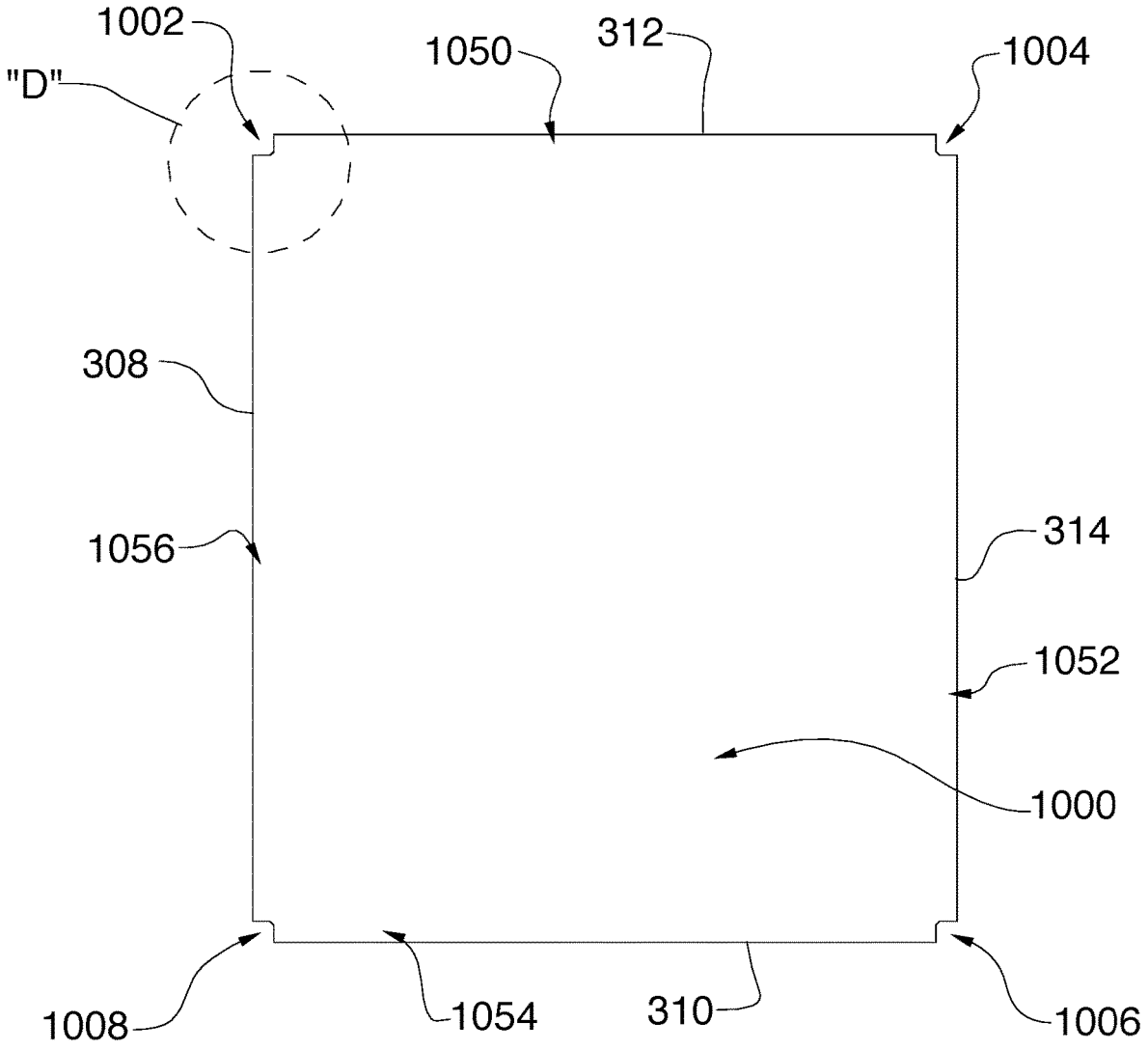
FIG. 12 is a top plan view of the slab illustrated in FIG. 10.

Referring now to FIGS. 4 and 9, the structural frame 100 may further include a plurality of corner column reinforcement members 900 adapted to anchor the corner columns **106*a*, 106*b*, 106*c*, 106*d* to the cured grouting in at least one adjacent perimeter elongated space 350. Similarly to the side column reinforcement members 800, the corner column reinforcement members 900 includes a female connector 902 extending through the corresponding corner column 106*a*, 106*b*, 106*c* or 106*d* and a rod portion 904 extending from the female connector 902 into the adjacent perimeter elongated space 350. The rod portion 904 is adapted to form a secure connection with the grout 750 to thereby preventing the grouting from moving longitudinally away from the corner columns 106*a*, 106*b*, 106*c*, 106*d***.

Once the grout 750 has been poured, the building can be completed using techniques and components known in the art. For example, precast cladding, made for example of insulated or glass panels, could be positioned around the perimeter of the structural frame to form the exterior of the building. Alternatively, the exterior of the building may be constructed using conventional finishes such as brick or stone, or even stucco. It will be understood that the final exterior design of the building will depend on various factors such as the environment and the budget of the building project.

In one embodiment and especially in relatively tall buildings, a plurality of shear walls may further be disposed between floors of the structural frame 100. Shear walls can be made of concrete which is cast in place at its desired location within the structural frame 100, and may be reinforced with vertical and horizontal rebar. The height and configuration of the shear walls may be selected according to specific design requirements.

Figure 15:
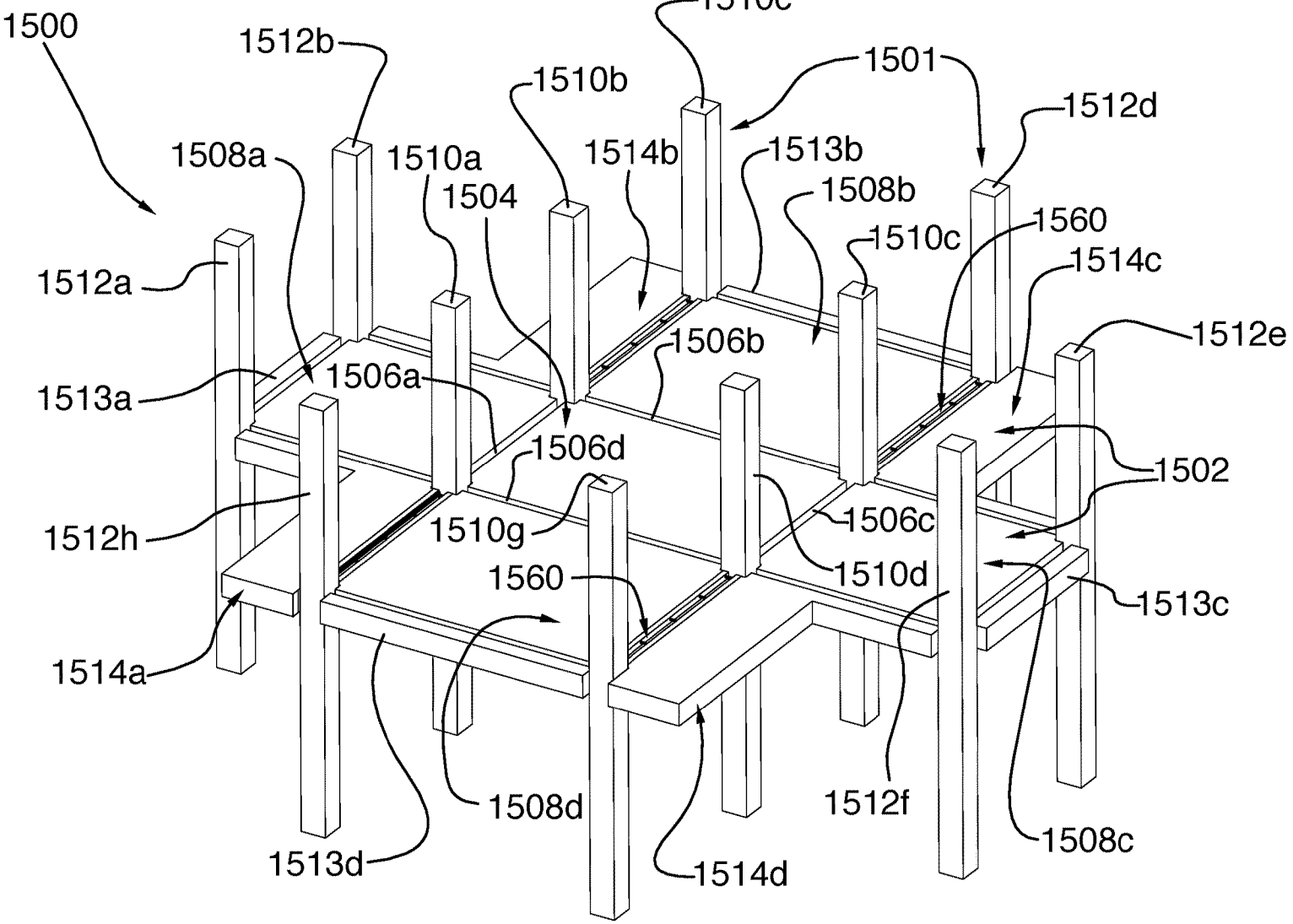
FIG. 15 is a perspective view of a structural frame for a building, in accordance with an alternative embodiment, in which the structural frame includes cantilevered corner slabs.
Figure 16A:
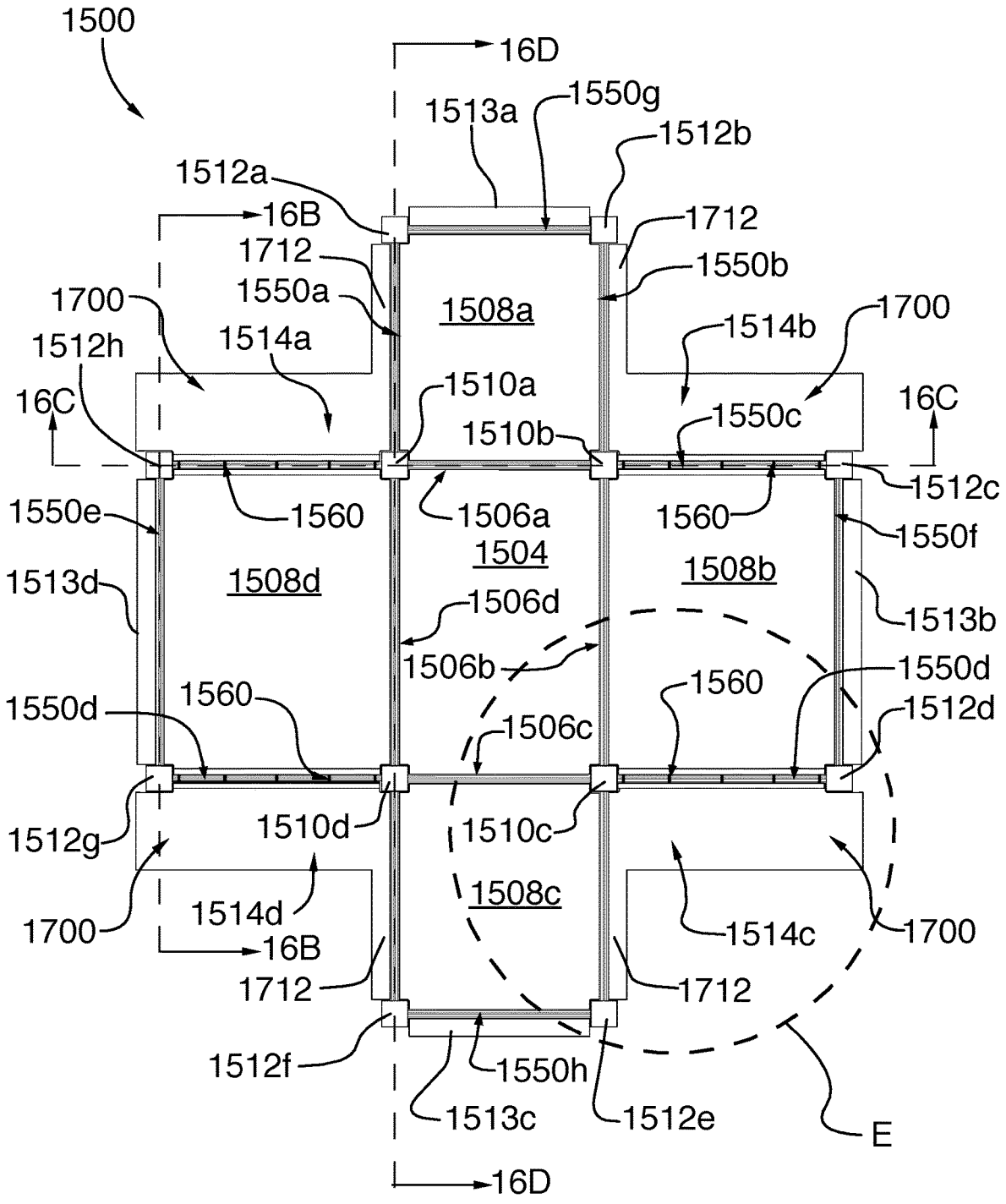
FIG. 16A is a top plan view of the structural frame illustrated in FIG. 15.
Figure 16B:
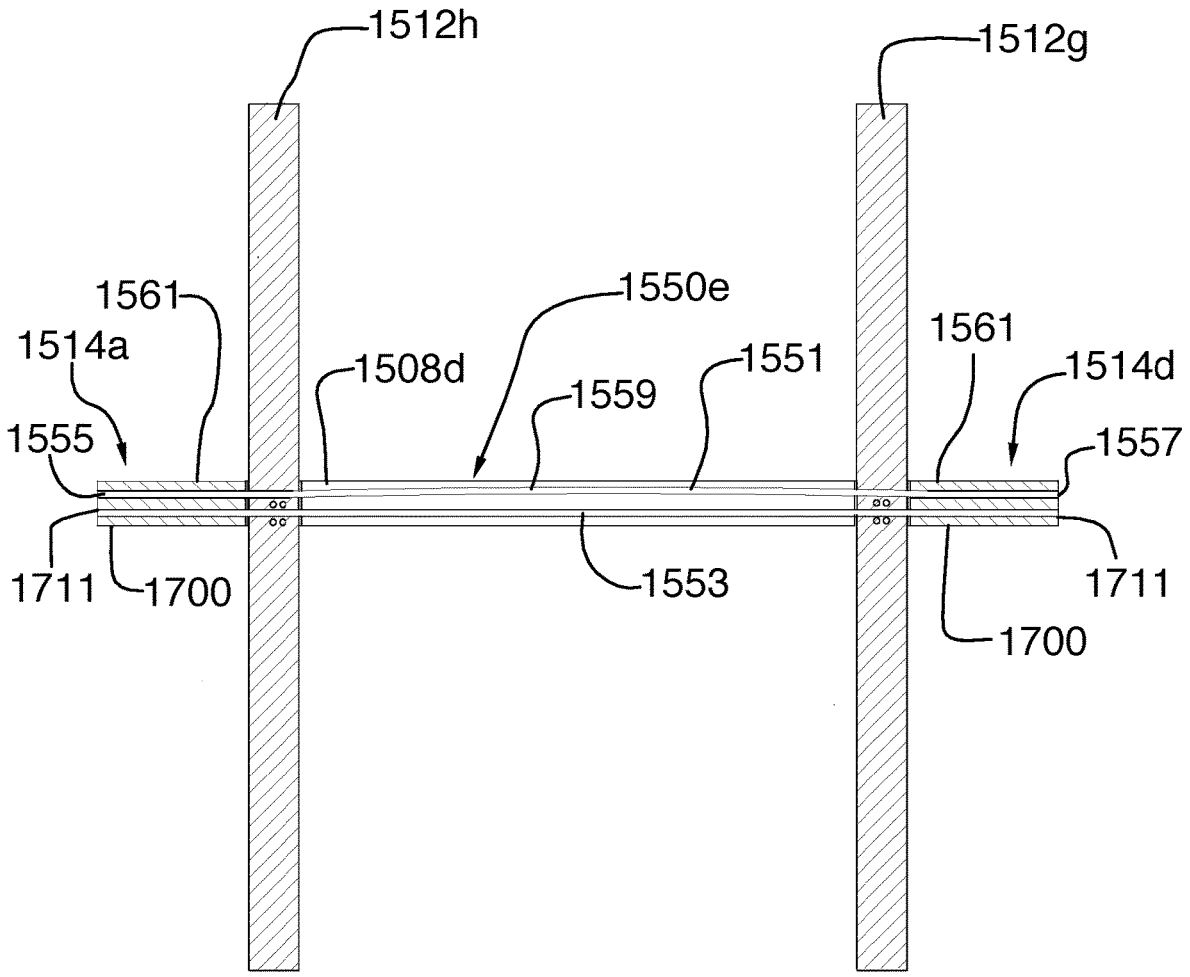
FIG. 16B is a cross-section view of the structural frame illustrated in FIG. 16A taken along line "16B-16B"
Figure 16C:
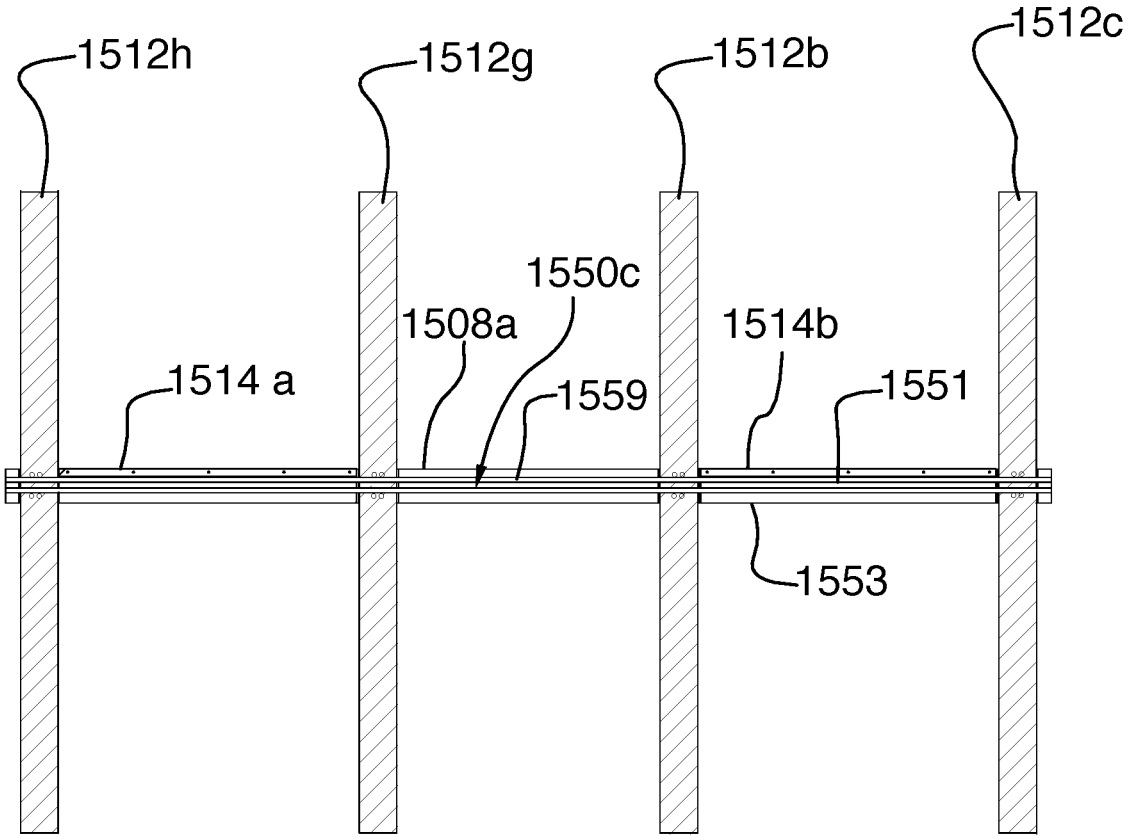
FIG. 16C is a cross-section view of the structural frame illustrated in FIG. 16A taken along line "16C-16C"
Figure 16D:
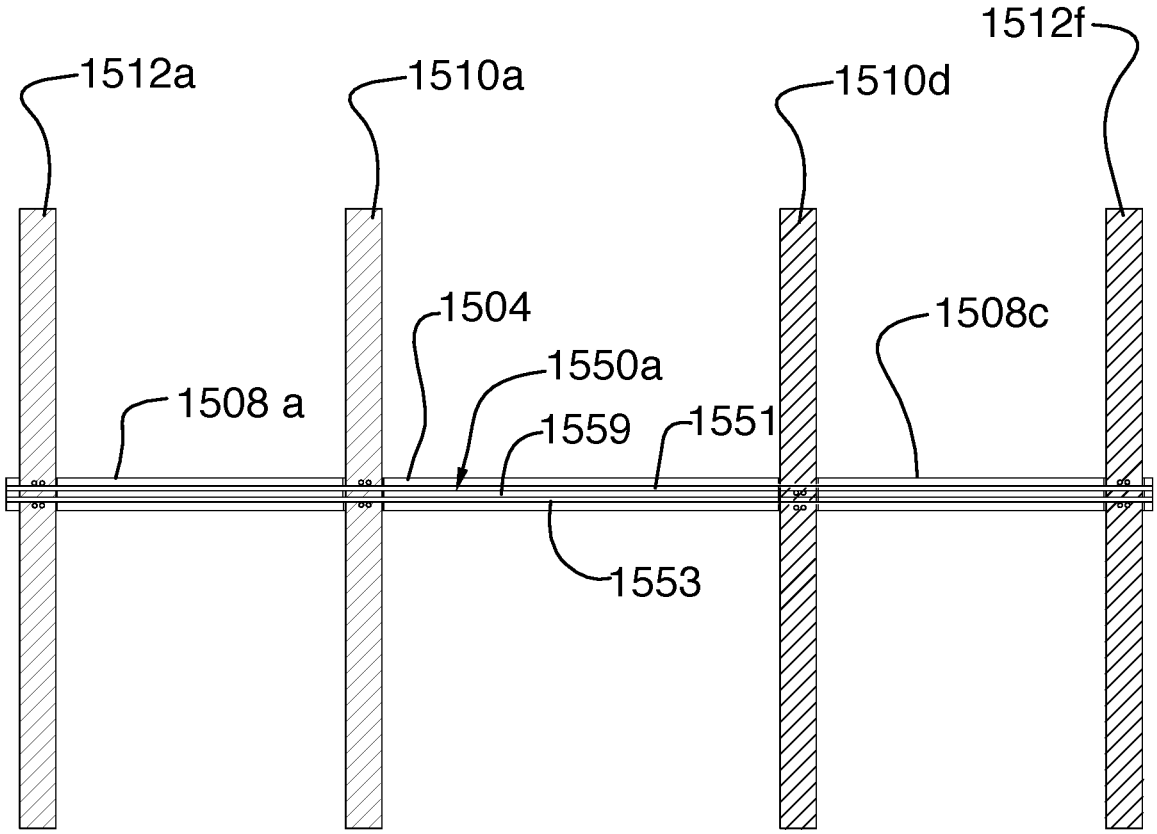
FIG. 16D is a cross-section view of the structural frame illustrated in FIG. 16A taken along line "16D-16D"
Figure 17:
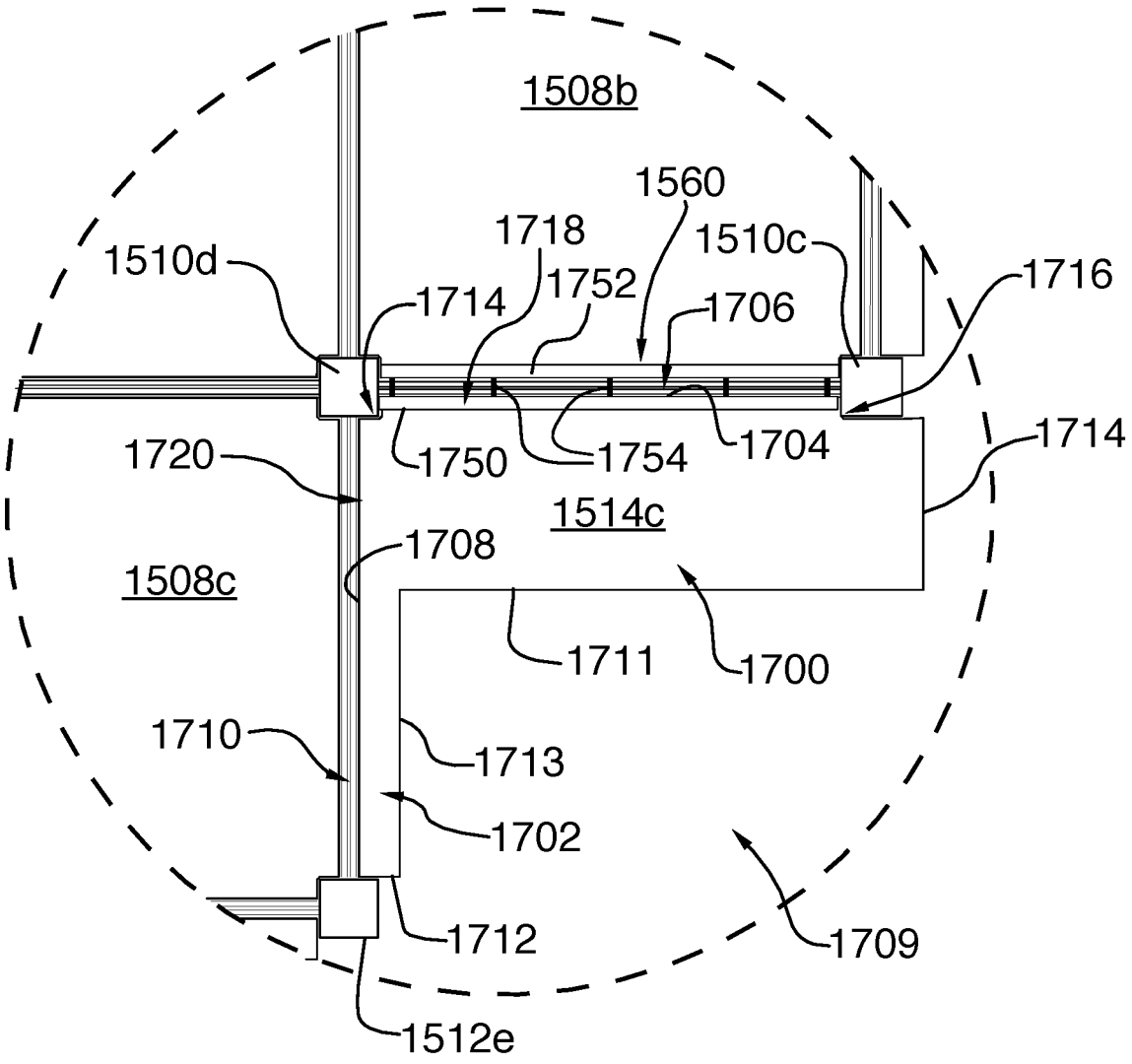
FIG. 17 is a top plan view of portion "E" of the structural frame illustrated in FIG. 16, to show details of a cantilevered corner slab.

Now turning to FIGS. 15 to 17, there is provided a structural frame 1500 of a building, in accordance with an alternative embodiment. The structural frame 1500 includes a plurality of columns 1501 and a plurality of slabs, identified generically with reference numeral 1502, which are generally similar to the columns 150 and slabs 104 illustrated in FIGS. 1 to 14 and described above, but arranged in a different configuration.

In the embodiment illustrated in FIGS. 15 to 17, the slabs 1502 include a central slab 1504 and four (4) side slabs—a first side slab 1508*a*, a second side slab 1508*b*, a third side slab 1508*c* and a fourth side slab 1508*d*—disposed in a cross-like configuration. The central slab 1504 has a first side 1506*a*, a second side 1506*b*, a third side 1506*c* and a fourth side 1506*d* and each side slab 1508*a*, 1508*b*, 1508*c* or 1508*d* is disposed adjacent a corresponding side 1506*a*, 1506*b*, 1506*c* or 1506*d* such that the central slab 1504 and the side slabs 1508*a*, 1508*b*, 1508*c*, 1508*d*.

Each one of the center slab 1504 and the side slabs 1508*a*, 1508*b*, 1508*c*, 1508*d* is held and compressed between adjacent columns located at the four corners of the slab 1504, 1508*a*, 1508*b*, 1508*c* or 1508*d* by a plurality of tendon assemblies, identified generically by reference numeral 1550, similarly to the slabs 104 described above. Specifically, the columns 1501 includes first, second, third and fourth central columns 1510*a*, 1510*b*, 1510*c*, 1510*d* which are disposed in a rectangular pattern at the four corners of the central slab 1504.

The columns 1501 further include eight (8) perimeter columns—first, second, third, fourth, fifth, sixth, seventh and eighth perimeter columns 1512*a*, 1512*b*, 1512*c*, 1512*d*, 1512*e*, 1512*f*, 1512*g*, 1512*h* which are spaced outwardly from the central columns 1510*a*, 1510*b*, 1510*c*, 1510*d*. Specifically, the first and second perimeter columns 1512*a*, 1512*b* are spaced away from the first and second central columns 1510*a*, 1510*b* to thereby form a rectangular pattern which is sized and shaped to receive the first side slab 1508*a*. The third and fourth perimeter columns 1512*c*, 1512*d* are spaced away from the second and third central columns 1510*b*, 1510*c* to thereby form a rectangular pattern sized and shaped to receive the second side slab 1508*b*. The fifth and sixth perimeter columns 1512*e*, 1512*f* are spaced away from the third and fourth central columns 1510*c*, 1510*d* to thereby form a rectangular pattern sized and shaped to receive the third side slab 1508*c*. The seventh and eighth perimeter columns 1512*g*, 1512*h* are spaced away from the fourth and first central columns 1510*d*, 1510*a* to thereby form a rectangular pattern sized and shaped to receive the fourth side slab 1508*d*.

In the embodiment illustrated in FIGS. 15 to 17, the structural frame 1500 further includes fourth perimeter beams—a first perimeter beam 1513*a*, a second perimeter beam 1513*b*, a third perimeter beam 1513*c* and a fourth perimeter beam 1513*d*—generally similar to the perimeter beams 120 illustrated in FIGS. 1 to 14 and described above. More specifically, the first perimeter beam 1513*a* extends between the first and second perimeter columns 1512*a*, 1512*b* and is spaced from the first side slab 1508*a*. The second perimeter beam 1513*b* extends between the third and fourth perimeter columns 1512*c*, 1512*d* and is spaced from the second side slab 1508*b*. The third perimeter beam 1513*c* extends between the fifth and sixth perimeter columns 1512*e*, 1512*f* and is spaced from the third side slab 1508*c*. The fourth perimeter beam 1513*d* extends between the seventh and eighth perimeter columns 1512*g*, 1512*h* and is spaced from the fourth side slab 1508*d*.

Still in the illustrated embodiment, the slabs 1502 further includes four (4) corner slabs—first, second, third and fourth corner slabs 1514*a*, 1514*b*, 1514*c*, 1514*d*—which generally extend away from the corners of the central slab 1504 and fill the gap between the side slabs 1508*a*, 1508*b*, 1508*c*, 1508*d*. More specifically, the first corner slab 1514*a* is disposed adjacent the first and fourth side slabs 1508*a*, 1508*d*, the second corner slab 1514*b* is disposed adjacent the first and second side slabs 1508*a*, 1508*b*, the third corner slab 1514*c* is disposed adjacent the second and third side slabs 1508*b*, 1508*c* and the fourth corner slab 1514*d* is disposed adjacent the third and fourth side slabs 1508*c*, 1508*d*.

Unlike the center slab 1504 and the side slab 1508*a*, 1508*b*, 1508*c*, 1508*d*, the corner slabs 1514*a*, 1514*b*, 1514*c*, 1514*d* are cantilevered. More specifically, each corner slab 1514*a*, 1514*b*, 1514*c*, 1514*d* is held between three columns 1502 instead of four columns 1502.

Referring specifically to FIG. 17, the third corner slab 1514*c* will now be described, the first, second and fourth corner slabs 1514*a*, 1514*b*, 1514*d* being generally similar to the third corner slab 1514*c*.

The third corner slab 1514*c* is generally L-shaped and includes first and second elongated portions 1700, 1702 which are generally perpendicular to each other. The first elongated portion 1700 is located towards the second side slab 1508*b* and the second elongated portion 1702 is located towards the third side slab 1508*c*.

The first elongated portion 1700 includes a first inner edge 1704 which is spaced from the second side slab 1508*b* to define a first elongated space 1706. Similarly, the second elongated portion 1702 includes a second inner edge 1708 which is spaced from the third side slab 1508*c* to define a second elongated space 1710.

The third corner slab 1514*c* further includes a rectangular indent 1709 defining first and second indent edges 1711, 1713 which are respectively parallel to the first and second inner edges 1704, 1708.

Still referring specifically to FIG. 17, the third corner slab 1514*c* further includes a first outer edge 1712 located opposite, and parallel to, the first inner edge 1704 and a second outer edge 1714 located opposite, and parallel to, the second inner edge 1708.

The third corner slab 1514*c* further includes a first corner indent 1714 located between the first and second inner edges 1704, 1708 and a second corner indent 1716 located between the first inner edge 1704 and the second outer edge 1714. A first elongated edge beam 1718 is further defined in the first inner edge 1704 between the first and second corner indents 1714, 1716. The first corner indent 1714 is sized and shaped to receive the third central column 1510*c* and the second corner indent 1716 is sized and shaped to receive the fourth perimeter column 1512*d* such that the first elongated edge beam 1718 extends between the third central column 1510*c* and the fourth perimeter column 1512*d*.

In the embodiment illustrated in FIGS. 15 to 17, a second elongated edge beam 1720 is also defined between the first corner indent 1714 and the first outer edge 1712. When the third center column 1510*c* is received in the first corner indent 1714, the first outer edge 1712 of the third corner slab 1514*c* abuts the fifth perimeter column 1512*e* such that the second elongated edge beam 1720 extends between the third center column 1510*c* and the fifth perimeter column 1512*e*.

Referring specifically to FIGS. 16A through 16D, to tie the slabs 1502 together, the tendon assemblies 1550 include: first and second tendon assemblies 1550*a*, 1550*b* extending parallel to each other; third and fourth tendon assemblies 1550*c*, 1550*d* extending parallel to each other and perpendicular to the first and second tendon assemblies 1550*a*, 1550*b*; fifth and sixth tendon assemblies 1550*e*, 1550*f* extending parallel to each other and to the first and second tendon assemblies 1550*a*, 1550*b*; and seventh and eighth tendon assemblies 1550*g* and 1550*h* extending parallel to each other and to the third and fourth tendon assemblies 1550*c*, 1550, as clearly shown in FIG. 16A. In this embodiment, each tendon assembly 1550*a* through 1550*h* includes two pairs of tendons—an upper pair of tendons 1551 and a lower pair of tendons 1553—disposed symmetrically about the respective vertical center plane of each column the tendons intersect.

As shown in FIG. 16D, the first tendon assembly 1550*a* extends between the first and sixth side columns 1512*a*, 1512*f* through the first and fourth central columns 1510*a*, 1510*d* to tie the first corner slab 1514*a*, the first side slab 1508*a*, the fourth side slab 1508*d*, the central slab 1504, the fourth corner slab 1514*d* and the third side slab 1508*c* to each other.

The second tendon assembly 1550*b* extends between the second and fifth side columns 1512*b*, 1512*e* through the second and third central columns 1510*b*, 1510*c* and connects the first side slab 1508*a*, the first corner slab 1514*b*, the central slab 1504, the second side slab 1508*b*, the third side slab 1508*c* and the third corner slab 1514*c* and to each other.

As illustrated in FIG. 16C, the third tendon assembly 1550*c* extends between the eighth and third perimeter columns 1512*h* and 1512*c* through the first and second central columns 1510*a*, 1510*b* and joins the fourth side slab 1508*d*, the first corner slab 1514*a*, the central slab 1504, the first side slab 1508*a*, the second side slab 1508*b* and the second corner slab 1514*b*.

The fourth tendon assembly 1550*d* extends between the seventh and fourth perimeter columns 1512*g* and 1512*d* through the fourth and third central columns 1510*d*, 1510*c* and joins the fourth corner slab 1510*d*, the fourth side slab 1508*d*, the third side slab 1508*c*, the central slab 1504, the third corner slab 1514*c* and the second side slab 1508*b*.

The fifth tendon assembly 1550*e* extends through the first corner slab 1514*a*, the fourth side slab 1508*d* and the fourth corner slab 1514*d*. More specifically, the fifth tendon assembly 1550*e* is tied at one end 1555 to the first indent edge 1711 of the first corner slab 1514*a*. It runs through the entire width of the elongated portion 1700 of the first corner slab 1514*a* and further extends through the eighth perimeter column 1512*h*, the fourth side slab 1508*d* and the seventh perimeter column 1512*g* and into the fourth corner slab 1514*d*, where the opposite end 1557 of the fifth tendon assembly 1550*e* is tied to the first indent edge 1711 of the fourth corner slab 1514*d*.

FIG. 16B shows the ends 1555 and 1557 of the upper pair of tendons 1551 of the fifth tendon assembly 1550*e* being carried at a height lower than that of the midspan portion 1559 of the upper pair of tendons 1551 so as to impart a parabolic-shaped profile to the upper pair of tendons 1551. This tends to ensure that the top surface 1561 of the first and second corner slabs 1514*a* and 1514*b*. is placed in compression as the first corner slab 1514*a* bears against eight perimeter column 1512*h* and the fourth corner slab 1514*d* bears against the seventh perimeter column 1512*g*. This arrangement could also be adopted for the respective upper pairs of tendons of the other tendon assemblies. However, in the embodiments shown in FIGS. 16C and 16D, this is not the case, the respective upper pairs of tendons 1551 in those drawings are shown being carried at substantially the same height as the midspan portion 1559.

The sixth tendon assembly 1550*f* extends through the second corner slab 1514*b*, the second side slab 1508*b* and the third corner slab 1514*c*. More specifically, the sixth tendon assembly 1550*f* is tied at one end to the first indent edge 1711 of the second corner slab 1514*b*. It runs through the entire width of the elongated portion 1700 of the second corner slab 1514*b* and further extends through the third perimeter column 1512*c*, the second side slab 1508*b* and the fourth perimeter column 1512*d* and into the third corner slab 1514*c*, where the opposite end of the sixth tendon assembly 1550*f* is tied to the first indent edge 1711 of the third corner slab 1514*c*. The distribution of the sixth tendon assembly 1550*f* is similar to that shown in FIG. 16B.

The seventh tendon assembly 1550*g* is relatively short and extends between the first and second perimeter columns 1512*a* and 1512*b*. In like fashion, the eighth tendon assembly 1550*h* is also relatively short and extends between the sixth and fifth perimeter columns 1512*f* and 1512*e*.

It will be appreciated that when the tendon assemblies 1550*a* through 1550*h* are tensioned the cantilevered corner slabs 1514*a*, 1514*b* 1514*c* and 1514*d* are firmly retained and supported by the surrounding structures. By way of illustration, looking at the first corner slab 1514*a*, a person skilled in the art will appreciate that the first elongated portion 1700 will be held in compression against the eighth perimeter column 1512*h*, the central column 1510*a*, and the first perimeter column 1512*a* by virtue of the fifth tendon assembly 1550*e*, the third tendon assembly 1550*c* and the first tendon assembly 1550*a*, respectively. This configuration tends to sufficient to hold the first corner slab 1514*a* in a cantilevered configuration without the aid of a fourth column.

It will also be appreciated that instead of the first outer edge 1712 abutting the fifth perimeter column 1512*e*, the third corner slab 1514*c* could instead include a third corner indent adapted to receive the fifth perimeter column 1512*e*, similarly to the first and second corner indents 1714, 1716.

In the embodiment illustrated in FIGS. 15 to 17, the structural assembly 1500 further includes a plurality of bracing assemblies 1560 which further secure adjacent slabs 1502 together.

Referring again specifically to FIG. 17, each bracing assembly 1560 includes first and second parallel angle members 1750, 1752 extending along the first elongated space 1706. More specifically, the first angle member 1750 is embedded in the third corner slab 1514*c* along the first inner edge 1704 and the second angle member 1752 is embedded in the second side slab 1508*b* opposite the first angle member 1752. The bracing assembly 1560 further includes a plurality of spaced-apart brace members 1754 extending between the first and second angle members 1750, 1752 across the first elongated space 1706. The brace members 1754 could be secured to the angle members 1750, 1752 by welding or using another appropriate securing technique known to the skilled addressee.

In one embodiment, the brace members 1754 are secured to the first and second angle members 1750, 1752 after the tendon assemblies 1550 are properly installed and tensioned to further secure adjacent slabs together. This may be particularly useful to secure a cantilevered corner slab to adjacent slabs and to allow the cantilevered corner slab to support loads since the corner slab is only held between three columns instead of four columns.

Although only bracing assemblies 1560 are only illustrated between the corner slabs 1514*a*, 1514*b*, 1514*c*, 1514*d* and the second and fourth side slabs 1508*b*, 1508*d* in FIGS. 15, 16A and 16B, it will be understood that other bracing members may be used between the corner slabs 1514*a*, 1514*b*, 1514*c*, 1514*d* and the first and third side slabs 1508*a*, 1508*c* and even between the side slabs 1508*a*, 1508*b*, 1508*c*, 1508*d* and the central slab 1504.

It will be understood that the structural frame could have other configurations than the ones described above. For example, the perimeter beams 120 could be replaced by additional slabs 104 to extend the floor to a size larger than a two-by-two configuration.

Figure 18:
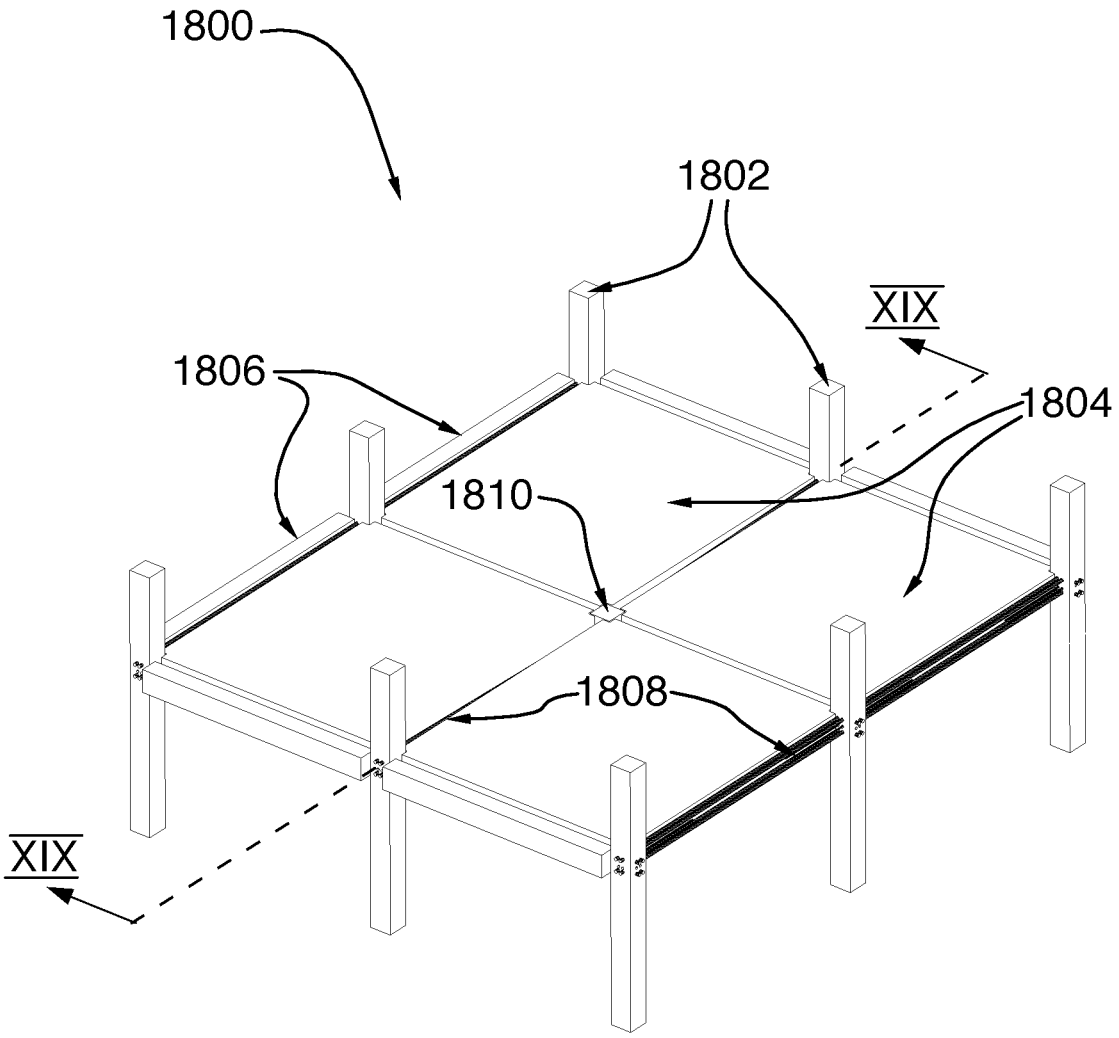
FIG. 18 is a perspective view of a structural frame for a building, in accordance with another alternative embodiment, in which the structural frame includes four slabs arranged in a two-by-two configuration and an insert piece disposed between the slabs instead of a central column.
Figure 19:
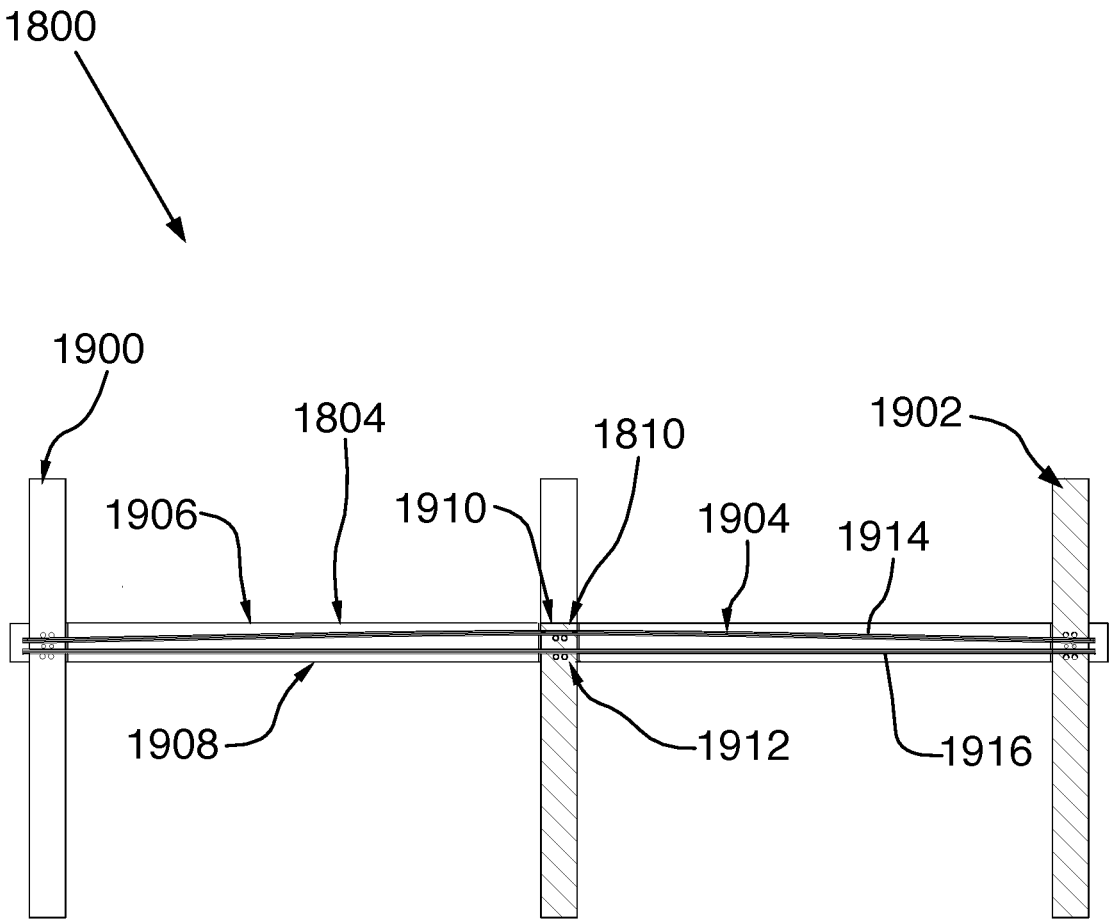
FIG. 19 is a cross-sectional view of the structural frame illustrated in FIG. 1, taken along cross-section lines XIX-XIX, showing the orientation of upper and lower cables between the perimeter columns and the insert piece.

Turning now to FIGS. 18 and 19, there is shown another alternative embodiment of a structural frame 1800. In this embodiment, the structural frame 1800 includes a plurality of columns 1802, four slabs 1804 disposed in a two-by-two configuration to define a floor and a plurality of perimeter beams 1806 disposed around the slabs 1804. The columns 1802, slabs 1804 and perimeter beams 1806 are generally similar to the columns, slabs and tendons illustrated in FIGS. 1 to 14 and are assembled as described above using a plurality of tensioned tendon assemblies 1808 extending between the slabs 1806 and between the slabs 1804 and the perimeter beams 1806.

Still in the embodiment illustrated in FIGS. 18 and 19, the columns 1802 are located on a perimeter of the floor and, instead of a central column, the structural frame 1800 includes a rectangular insert piece 1810 located at the center of the floor between the slabs 1804. In this embodiment, the insert piece 1810 is a short reinforced concrete block.

Referring now specifically to FIG. 19, the insert piece 1810 is generally located midway between opposite first and second perimeter columns 1900, 1902. A first inner tendon assembly 1904 further extends between the first and second perimeter columns 1900, 1902. Specifically, the insert piece could include horizontal openings adapted to receive the first inner tendon assembly 1904, similarly to the first and second horizontal openings of the central column 108.

In this configuration, when the inner tendon assembly 1904 is tensioned, the slabs 104 are therefore compressed between the first perimeter column 1900 and the insert piece 1810 and between the second perimeter column 1902 and the insert piece 1810 and are thereby secured together similarly to the slabs 104 as described above.

Still referring to FIG. 19, the insert piece 1810 has a relatively similar thickness as the slabs 1804. Specifically, each slab 1804 includes generally parallel top and bottom surfaces 1906, 1908. The insert piece 1810 includes a top surface 1910 which is coplanar with the top surface 1906 of the slabs 1804 and a bottom surface 1912 which is coplanar with the bottom surface 19 of the slabs 1804. This configuration enables the entire floor to form a continuous floor surface with an open area which is not interrupted by columns.

It will be appreciated that unlike a central column, the insert piece 1810 does not provide any vertical support to the floor. Therefore, the weight of the floor and loads on the floor may cause a certain amount of sag in the inner tendon assembly 150 at the center of the floor where the insert piece 1810 is located.

In the embodiment illustrated in FIG. 19, the first inner tendon assembly 1904 includes a pair of upper cables 1914 and a pair of lower cables 1916 located below the upper cables 1914. It will be understood that since FIG. 19 is a cross-sectional view, only a single upper cable and a single lower cable are illustrated.

When tensioned, the lower cables 1916 extend generally horizontally while the upper cables 1914 have a generally parabolic profile with the middle portion of the upper cables 1914 sagging. More specifically, the upper cables 1914 are angled downwardly from the first perimeter column 1900 to the insert piece 1910 and angled upwardly from the insert piece 1910 to the second perimeter column 1902. It will be appreciated that in this configuration, the vertical loads on the floor are fully supported by the tension in the cables 1914, 1916.

In another embodiment, the floor could include a relatively large central opening such as floors of an atrium-type building. In this case, additional tendon assemblies could extend between columns located on the perimeter of the opening and columns located on the perimeter of the building.

In yet another embodiment, instead of being located between perimeter columns, one or more slabs could be cantilevered from a floor. Specifically, the cantilevered slab would include a proximal edge adjacent another slab of the structural frame and a distal edge located away from the structural frame. The cantilevered slab could only include two corner indents 1002, 1004, 1006, 1008 for receiving two adjacent perimeter columns, and a pair of tendon assemblies could extend between the perimeter columns and the distal side of the slab such that tension in the tendon assemblies maintains the cantilevered slab in a generally horizontal position.

It will be appreciated that the configuration described above may greatly facilitate the construction of a building, and thereby reduce the cost and time associated with the construction of a new building. Since the slabs, column portions and perimeter beams are precast remotely from the construction site, they can be easily carried to the construction site and quickly assembled together when provided at the construction site.

The columns, slabs and perimeter beams of the frame described above further define elements of a modular system which can be connected together using the tendon assemblies into a desired configuration. This would allow the columns and slabs to be manufactured in advance according to standard, predetermined dimensions, for example, and provided in specific quantities as a kit for a user to assemble depending on the desired area and configuration of the floor and the desired height of the building, further minimizing the costs of building a building compared to more costly customs designs.

The modularity of the frame also makes the frame described above easy to scale for larger or smaller project. For example, the frame could be used for the construction of an individual house, or a condominium or apartment which could be two (2) to six (6) stories high, a medium to high-rise building which could have a height of 25 stories or more and which could be used for apartments, offices, as a school or a hospital. The structural frame could further be particularly well suited for buildings in which the structure may, for various reasons, be difficult to construct or for buildings which are to be constructed in areas which are relatively far from concrete plants that lack the capability to transport fresh concrete to the construction site.

Moreover, the use of columns and slabs in standard sizes and configurations could further reduce the amount of equipment and tooling needed to manufacture the slabs and columns, thereby minimizing the cost of manufacturing the building frame and therefore further minimizing the cost of building a building. The present frame could therefore be particularly well-adapted to meet high volume constructions needs, but could be used as well to build a limited number of buildings with specific architectures.

Alternatively, instead of providing all of the slabs, columns and perimeter beams as precast components, the structural system could include a combination of precast components and other components which are cast on-site, depending on the specific requirements of the project.

A skilled person will also appreciate that the use of precast slabs with integrated side beams (i.e. the rectangular elongated edge beam 1050, 1052, 1054, 1056) ensures that the side beams, which extend in the same plane as the planar top face 1000 of the slab 104, will be generally the same thickness as the rest of the slab, rather than being too large as is often seen in conventional structural building systems. The integration of the side beams with the slabs further eliminates the need to assemble the side beams with the slabs on the construction site, further facilitating and accelerating the construction of the building frame.

Moreover, the perimeter beams can be easily substituted to edge beams of slabs to define the perimeter of the building structure, thereby eliminating the need to manufacture distinct slabs which would be specifically configured to be used on the perimeter of the building structure. Spacing the perimeter beams from the slabs also creates elongated spaces between the perimeter beams and the slabs to receive the perimeter tendon assemblies. The elongated spaces are open and allow grout to be easily poured over the perimeter tendon assemblies, as opposed to if the perimeter tendons assemblies were enclosed in a closed channel.

It will also be appreciated that the use of at least one left cable and at least one right cable in each tendon assembly further contributes to enhancing the rigidity of the floor subjected to vertical loads and reduces or even eliminates torsion between adjacent slabs.

Finally, the buildings built using this structure tend to be very rigid and sturdy integrated structures with enhanced ability to resist severe weather and other natural disasters such as strong winds, hurricanes, tornadoes and high-intensity seismic activity, as well as being sufficiently fireproof to meet local building requirements. In one embodiment, the buildings constructed using the structural frame described above could have a service life of 50 years or more.

The invention claimed is:

1. A structural frame for a building, the structural frame comprising:

a plurality of columns including a first, second, third, fourth, fifth, sixth, seventh, eighth and ninth columns;

a plurality of precast concrete floor slabs including first, second, third and fourth precast concrete floor slabs arranged in a grid configuration with the first and second floor slabs disposed in a spaced apart, side-by-side arrangement, the third and fourth floor slabs disposed side-by-side in a spaced apart, side-by-side arrangement, the first floor slab being positioned adjacent to and spaced apart from the third floor slab and the second floor slab being positioned adjacent to and spaced apart the fourth floor slab; each floor slab having corner indents defined in each side thereof forming an elongated edge beam extending between adjacent corner indents; each corner indent receiving one of the plurality of columns; each elongated edge beam being disposed between, and abutting, a pair of adjacent columns of the plurality of columns; and a plurality of tendon assemblies including first, second, third, fourth, fifth and sixth tendon assemblies; each tendon assembly including at least one left cable and at least one right cable; each tendon assembly being associated with at least one pair of adjacent floor slabs and being adapted to be tensioned to thereby compress elongated edge beams of the at least one pair of adjacent floor slabs between respective pairs of adjacent columns.

2. The structural frame of claim 1 wherein:

the first, fourth, fifth tendon assemblies are parallel to each other; and the second, third and sixth tendon assemblies are parallel to each other.

3. The structural frame of claim 1 wherein:

the first, second, third, fourth tendon assemblies are outer tendon assemblies; and the fifth and sixth tendon assemblies are inner tendon assemblies.

4. The structural frame of claim 3 wherein the interior tendon assemblies are disposed perpendicular to each other.

5. The structural frame of claim 3 wherein each inner tendon assembly is adapted to compress elongated edge beams of the first, second, third and fourth floor slabs between respective pairs of adjacent columns.

6. The structural frame as claimed in claim 1, wherein the third column is an interior column and the first, second, third, fourth, fifth, sixth, seventh, eighth and ninth columns are perimeter columns.

7. The structural frame of claim 6 wherein:

the corner indents of the first slab receive the first, second, third and fourth columns;

the corner indents of the second slab receiving the third, fourth, fifth and sixth columns;

the corner indents of the third slab receiving the second, third, seventh and eighth columns; and the corner indents of the fourth slab receiving the third, sixth, eighth and ninth columns.

8. The structural frame of claim 7, wherein:

the first tendon assembly is adapted to compress elongated edge beams of the first and second floor slabs between the first and fourth columns and the fourth and fifth columns;

the second tendon assembly is adapted to compress elongated edge beams of the first and third floor slabs between the first and second columns and the second and seventh columns;

the third tendon assembly is adapted to compress elongated edge beams of the second and fourth floor slabs between the fifth and sixth columns and the sixth and ninth columns;

the fourth tendon assembly is adapted to compress elongated edge beams of the third and fourth floor slabs between the seventh and eighth columns and the seventh and ninth columns;

the fifth tendon assembly is adapted to compress elongated edge beams of the first, second, third and fourth floor slabs between the second and third columns and the third and sixth columns; and the sixth tendon assembly is adapted to compress elongated edge beams of the first, second, third and fourth floor slabs between the fourth and third columns and the third and eighth.

9. The structural frame of claim 6, further including at least one perimeter beam extending between a corresponding at least one adjacent pair of perimeter columns.

10. The structural frame of claim 6, further including a plurality of perimeter beams, each perimeter beam extending between an adjacent pair of perimeter columns and arranged so as to be compressed between the adjacent pair of perimeter columns when the tendon assembly associated with the adjacent pair of perimeter columns is tensioned.

11. The structural frame as claimed in claim 10, wherein the perimeter beam has a rectangular cross-section.

12. The structural frame of claim 1 wherein each tendon assembly is positioned within an elongated space between respective pairs of adjacent columns and the elongated space receives grout for encasing the each tendon assembly.

13. The structural frame of claim 12, further including a plurality of column reinforcement members, each column reinforcement member including a female connector extending through a corresponding one of the first and second adjacent columns and a rod portion engaging the female connector and extending into the elongated space to anchor the corresponding adjacent column to the grout in the elongated space.

14. The structural frame as claimed in claim 1, wherein each floor slab includes a plurality of ribs extending below the top face between opposite sides of the slab for providing rigidity to the floor slab.

15. The structural frame as claimed in claim 14, wherein the plurality of ribs includes first and second parallel ribs and third and fourth parallel ribs extending perpendicularly to the first and second parallel ribs.

16. A structural frame for a building, the structural frame comprising:

a plurality of perimeter columns including a first, second, third, fourth, fifth, sixth, seventh and eighth perimeter columns;

a central insert;

a plurality of precast concrete floor slabs including first, second, third and fourth precast concrete floor slabs arranged in a grid configuration with the first and second floor slabs disposed in a spaced apart, side-by-side arrangement, the third and fourth floor slabs disposed side-by-side in a spaced apart, side-by-side arrangement, the first floor slab being positioned adjacent to and spaced apart from the third floor slab and the second floor slab being positioned adjacent to and spaced apart the fourth floor slab; each floor slab having corner indents defined in each side thereof forming an elongated edge beam extending between adjacent corner indents; each corner indent receiving one of the central insert and one perimeter column of the plurality of perimeter columns; each elongated edge beam being disposed between, and abutting, either one of the central insert and one perimeter column of the plurality of perimeter columns or a pair of adjacent perimeter columns of the plurality of perimeter columns; and a plurality of tendon assemblies including first, second, third, fourth, fifth and sixth tendon assemblies; each tendon assembly including at least one left cable and at least one right cable; each tendon assembly being associated with at least one pair of adjacent floor slabs and being adapted to be tensioned to thereby compress elongated edge beams of the at least one pair of adjacent floor slabs between respective pairs of adjacent columns or between one pairing of the central insert with one perimeter column and another pairing of the central insert and another perimeter column.

17. The structural frame of claim 16 wherein:

the first, fourth, fifth tendon assemblies are parallel to each other; and the second, third and sixth tendon assemblies are parallel to each other.

18. The structural frame of claim 16, further including at least one perimeter beam extending between a corresponding at least one adjacent pair of perimeter columns.

19. The structural frame of claim 16 wherein:

the first, second, third, fourth tendon assemblies are outer tendon assemblies; and the fifth and sixth tendon assemblies are inner tendon assemblies.

20. The structural frame of claim 19 wherein the interior tendon assemblies are disposed perpendicular to each other.

21. The structural frame of claim 19 wherein each inner tendon assembly is adapted to compress elongated edge beams of the first, second, third and fourth floor slabs between one pairing of the central insert with one perimeter column and another pairing of the central insert and another perimeter column.

22. The structural frame of claim 16 wherein:

the corner indents of the first slab receive the first, second and third perimeter columns and the central insert;

the corner indents of the second slab receiving the third, fourth and fifth perimeter columns and the central insert;

the corner indents of the third slab receiving the second, seventh and eighth perimeter columns and the central insert; and the corner indents of the fourth slab receiving the central insert and the sixth, seventh and eighth perimeter columns.

23. The structural frame of claim 22, wherein:

the first tendon assembly is adapted to compress elongated edge beams of the first and second floor slabs between the first and third perimeter columns and the third and fourth perimeter columns;

the second tendon assembly is adapted to compress elongated edge beams of the first and third floor slabs between the first and second perimeter columns and the second and sixth perimeter columns;

the third tendon assembly is adapted to compress elongated edge beams of the second and fourth floor slabs between the fourth and fifth perimeter columns and the fifth and eighth perimeter columns;

the fourth tendon assembly is adapted to compress elongated edge beams of the third and fourth floor slabs between the sixth and seventh perimeter columns and the seventh and eighth perimeter columns;

the fifth tendon assembly is adapted to compress elongated edge beams of the first, second, third and fourth floor slabs between the second perimeter column and the central insert and the central insert and the sixth perimeter column; and the sixth tendon assembly is adapted to compress elongated edge beams of the first, second, third and fourth floor slabs between the third perimeter column and the central insert and the central insert and the seventh perimeter column.

24. The structural frame of claim 16, further including a plurality of perimeter beams, each perimeter beam extending between an adjacent pair of perimeter columns and arranged so as to be compressed between the adjacent pair of perimeter columns when the tendon assembly associated with the adjacent pair of perimeter columns is tensioned.

25. The structural frame as claimed in claim 24, wherein the perimeter beam has a rectangular cross-section.

26. A structural frame for a building, the structural frame comprising:

a plurality of columns including a first, second, third, fourth, fifth, sixth, seventh, eighth, ninth, tenth, eleventh and twelfth columns;

a plurality of precast concrete floor slabs including first, second, third, fourth and fifth precast concrete floor slabs arranged in a t-shaped configuration with the second floor slab being centrally disposed and surrounded by the first, third, fourth and fifth floor slabs; the first floor slab being disposed opposite of the third floor slab and the fourth floor slab being disposed opposite the fifth floor slab; each floor slab having corner indents defined in each side thereof forming an elongated edge beam extending between adjacent corner indents; each corner indent receiving one of the plurality of columns; each elongated edge beam being disposed between, and abutting, a pair of adjacent columns of the plurality of columns;

a plurality of corner slabs including first, second, third and fourth corner slabs; the first corner slab disposed between, and supported in cantilevered fashion from, the first and fourth floor slab; the second corner slab disposed between, and supported in cantilevered fashion from, the first and fifth floor slab; the third corner slab disposed between, and supported in cantilevered fashion from, the third and fifth floor slab; the fourth corner slab disposed between, and supported in cantilevered fashion from, the third and fourth floor slab;

a plurality of short tendon assemblies including first, second, third, and fourth tendon assemblies; each short tendon assembly including at least one left cable and at least one right cable; each short tendon assembly being associated with one floor slab and being adapted to be tensioned to thereby compress one elongated edge beam of the one floor slab between a pair of adjacent columns; and a plurality of long tendon assemblies including fifth, sixth, seventh and eighth tendon assemblies; each long tendon assembly including at least one left cable and at least one right cable; each long tendon assembly being associated with four floor slabs and being adapted to be tensioned to thereby compress elongated edge beams of the four floor slabs between respective pairs of adjacent columns.

27. The structural frame of claim 26, further including at least one perimeter beam extending between a corresponding at least one adjacent pair of columns.

28. The structural frame of claim 26 wherein:

the corner indents of the first slab receive the first, second, third and fourth columns;

the corner indents of the second slab receive the third, fourth, fifth and sixth columns;

the corner indents of the third slab receive the fifth, sixth, seventh and eighth columns;

the corner indents of the fourth slab receive the fourth, sixth, ninth and tenth columns; and the corner indents of the fifth slab receive the third, fifth, eleventh and twelfth columns.

29. The structural frame of claim 28, wherein:

the first short tendon assembly is adapted to compress one elongated edge beam of the first floor slab between the first and second columns;

the second short tendon assembly is adapted to compress one elongated edge beam of the third floor slab between the seventh and eight columns;

the third short tendon assembly is adapted to compress one elongated edge beam of the fourth floor slab between the ninth and tenth and eight columns; and the fourth short tendon assembly is adapted to compress one elongated edge beam of the fifth floor slab between the eleventh and twelfth columns.

30. The structural frame of claim 29, further including first, second, third and fourth perimeter beams, the first perimeter beam extending between the first and second columns and arranged so as to be compressed therebetween when the first short tendon assembly is tensioned; the second perimeter beam extending between the seventh and eighth columns and arranged so as to be compressed therebetween when the second short tendon assembly is tensioned; the third perimeter beam extending between the ninth and tenth columns and arranged so as to be compressed therebetween when the third short tendon assembly is tensioned; the fourth perimeter beam extending between the eleventh and twelfth columns and arranged so as to be compressed therebetween when the fourth short tendon assembly is tensioned.

31. The structural frame of claim 28, wherein:

the first long tendon assembly is adapted to compress:

elongated edge beams of the first, second and third floor slabs between the first, fourth, sixth and eighth columns;

a first portion of the first corner slab between the first and fourth columns; and a first portion of the fourth corner slab between the sixth and eighth columns;

the second long tendon assembly is adapted to compress:

elongated edge beams of the first, second and third floor slabs between the second, third, fifth and seventh columns;

a first portion of the second corner slab between the second and third columns; and a first portion of the third corner slab between the fifth and seventh columns;

the third long tendon assembly is adapted to compress:

elongated edge beams of the fourth, second and fifth floor slabs between the ninth, fourth, third and eleventh columns;

a second portion of the first corner slab between the fourth and ninth columns; and a second portion of the second corner slab between the third and eleventh columns;

the fourth long tendon assembly is adapted to compress:

elongated edge beams of the fourth, second and fifth floor between the tenth, sixth, fifth and twelfth columns;

a second portion of the third corner slab between the fifth and twelfth columns; and a second portion of the fourth corner slab between the sixth and tenth columns.

32. The structural frame of claim 31 wherein each corner slab is L-shaped with the first portion thereof being perpendicular to the second portion thereof.

* * * * *